US006311441B1

(12) United States Patent
Beavers et al.

(10) Patent No.: US 6,311,441 B1
(45) Date of Patent: Nov. 6, 2001

(54) PANEL-BASED MODULAR WALL SYSTEM

(75) Inventors: Dale W. Beavers, Powell; Joseph S. Alexander, Blacklick; Doris Shlayn, Westerville, all of OH (US)

(73) Assignee: The Artglo Company, Columbus, OH (US)

( * ) Notice: Subject to any disclaimer, the term of this patent is extended or adjusted under 35 U.S.C. 154(b) by 0 days.

(21) Appl. No.: 09/524,660

(22) Filed: Mar. 13, 2000

(51) Int. Cl.[7] ..... E04H 1/06
(52) U.S. Cl. ..... 52/239; 52/220.7; 52/220
(58) Field of Search ..... 52/36.5, 239, 241, 52/242, 220.7, DIG. 4, 512, 506.06

(56) References Cited

U.S. PATENT DOCUMENTS

| | | | | |
|---|---|---|---|---|
| D. 405,976 | * | 2/1999 | Beall | D6/396 |
| 4,470,232 | * | 9/1984 | Condevaux et al. | 52/220 |
| 5,277,006 | * | 1/1994 | Ruster | 52/220.7 |
| 5,341,615 | * | 8/1994 | Hodges et al. | 52/220.7 |
| 5,406,760 | * | 4/1995 | Edwards | 52/239 |
| 5,930,963 | * | 8/1999 | Nichols | 52/239 |
| 6,167,664 | * | 1/2001 | Reuter et al. | 52/239 |
| 6,173,536 | * | 1/2001 | Boyce | 52/36.4 |

* cited by examiner

*Primary Examiner*—Carl D. Friedman
*Assistant Examiner*—Steve M. Varner
(74) *Attorney, Agent, or Firm*—Mueller and Smith, LPA

(57) ABSTRACT

Wall modules are formed with a steel upstanding support module having integrally formed vertical spaced apart support components with forwardly facing panel support surfaces. Utility channels are fabricated into the upper and lower regions of the support module and a horizontal panel lower support with an upwardly facing platform is provided about the lower portion of the module. A baseboard which is removable provides access to a lower utility channel. Thin, typically flexible panels having strip magnets adhesively bonded to the rearward surface about their periphery, are positioned such that the lower edge of the panel is abuttibly compressibly engaged with the platform and the panels are held in verticality by the magnetic interaction of the strip magnets with the flat module panel support surfaces. The decorative panel magnetic mounting approach may be expanded to preexisting facility walls utilizing a wall-borne lattice system.

11 Claims, 11 Drawing Sheets

PANEL-BASED MODULAR WALL SYSTEM

CROSS-REFERENCE TO RELATED APPLICATIONS

STATEMENT REGARDING FEDERALLY SPONSORED RESEARCH

Not applicable.

BACKGROUND OF THE INVENTION

Within existing architectural structures, landlords and businesses increasingly desire to make functional and aesthetic changes to interior spaces without significantly altering the building in a permanent way. These changes are made to transform the appearance of existing walls or displays, to accommodate new technology, or to provide for more efficient use of space. In order to effectuate these changes, existing walls must be modified or an independent wall system inserted.

For example, in the banking industry, small branch banks are being installed in remote locations, such as grocery stores, malls and superstores. While the space required to accommodate a branch bank may be small, for example, simply the space required for an ATM, installation is complicated, time-consuming and expensive. Because alterations are being made to an existing wall structure, a contractor or specialist must be hired. Existing wiring and plumbing must be located in order to avoid damage to these areas or to interface with the new equipment. Preparation of the space, including destruction of a portion of an existing wall, is noisy and disruptive and creates dirt and debris that may be a hazard to customers. As such, during the installation process either the entire store must be closed or a sufficient area around the work site roped off until completion. Given its complexity, installation is frequently a time-consuming process. Once completed, if problems arise, the contractor or specialist must be called. Further, the location cannot be removed without an even greater expenditure of time and money. Finally, the appearance of the branch bank, including artistry and advertising, cannot be easily changed.

In addition to wanting to make changes to existing wall structures, landlords and businesses frequently desire to "create space" by dividing large, open area into individual work spaces. In response to this need, a number of partition systems have been devised. In this regard, see U.S. Pat. Nos. 5,746,034 and 5,784,843. One type of partition system includes partial height partition panels detatchably interconnected. Another such partition system includes modular furniture wherein freestanding furniture units are positioned side-by-side with privacy screens utilized to create individual work areas. The success of these systems depends upon their flexibility and their ability to adapt to ever-changing space planning requirements. Additionally, these systems must be capable of providing necessary electrical, plumbing and telecommunications utilities to resulting workspaces. Structural integrity frequently is an issue with these partitions as they are interconnected to form a relatively complex system. Further, sturdiness of construction frequently must be balanced against mobility of the partition system.

While some of the functional difficulties of existing wall panels and partition systems have been addressed, the appearance or aesthetic character of these systems has not received attention. Moreover, the ability of such structures to convey information, artistry, or advertising has not been realized. While systems in the past may have a decorative component, they do not provide the artistic flexibility or changeability that is as consequential as design functionality. For businesses, such as restaurants, noticeable variations in interior appearance are a sign of success and are a reinvestment in the customer.

A need exists for a wall system that meets varying functional requirements, is mobile and easily installed, yet also gives a user the capability of easily transforming its appearance.

BRIEF SUMMARY OF THE INVENTION

The present invention is addressed to a module and system for establishing an artistically enhancing and structurally robust space defining periphery within the interior of a facility. The system is formed with interconnected support modules which typically are about eight feet tall and formed in unitary fashion from sheet steel having a ferrous metal content to achieve magnetic responsiveness. These basic and robust structures incorporate vertical side support components which are spaced apart to define a forwardly open cavity surmounted by flat magnetically responsive panel support surfaces. Upper and lower utility channels are manufactured with the support modules for providing raceways for electrical and other utility lines extending along interconnected combinations of the wall defining module components. The support modules stand upon a floor somewhat independently and are capable of being retained in such standing vertical orientation by interconnecting them utilizing three or four bolt and wingnut assemblies. The lower, utility channel containing region of each module is configured to support a hand removable baseboard to provide easy access to continued utilities. Additionally, this lower region incorporates a channel-form upwardly opening panel lower support or platform.

A thin, decorative and typically flexible module panel is positioned against the forward facing panel support in a manner enclosing the noted cavity. Support of this panel is achieved initially by placing its lower edge upon the lower support or platform and erecting it into a vertical orientation such that the thin panel stands in structural compression upon its lower edge. The vertical orientation of this relatively large but thin panel is maintained by providing a magnetic interaction between the periphery of the rearward surface of the panel and the peripherally disposed forwardly facing magnetically responsive flat panel support surfaces. In this regard, relatively small attachment force is required to retain the verticality of the panels. To develop this magnetic coupling, polymeric strip magnets are adhesively fixed to the periphery of the rearward face of each panel. Advantageously, such magnetic coupling of the panels to the support modules permits their easy removal and replacement such that the decor developed with the panels easily is altered by the user. In effect, the wall modules are designed for future image revision. Additionally, because of their modularity, the modules themselves can be repositioned within a facility.

With such a wall module structuring, panels carrying decorative wall finishes are featured, as well as panels carrying art images, graphics and advertising. By mounting lighting appliances such as florescent tubes within the interior cavities of the modules, image carrying transparent panels may be backlit to evoke a dramatic visual effect.

The support modules are readily formed having a curvature to enhance their architectural flexibility and by virtue of the magnetic coupling of the panels, essentially all surfaces including both the forward region and the rearward region of each wall module may carry panels. Additionally, the system lends itself to utilization of smaller panels such as beam defining panels which, again contribute to architectural flexibility and may be utilized in conjunction with the mounting of commercial doors with the wall modules. Architectural capabilities for the system are enhanced by permitting the complimentary expansion of the magnetically supported decorative panels to mounting at the surfaces of preexisting facility walls. To carry this out, a lattice of brackets and magnetically responsive panel support components is anchored to a wall surface. By providing this form of dual component lattice, variations from verticality or plumb of a wall, as well as distortions thereof can be accommodated for easily. Following formation of the wall-borne lattice, the panels are mounted in the same fashion. In this regard, the lower edge of the larger panel is abuttably positioned upon an upwardly open platform and the panel peripheries are then magnetically retained in a vertical orientation. Of course, the wall-borne panels easily may be removed for decorative revision.

Another feature of the system of the invention provides a wall module and wall decorating system which is easily installed by relatively unskilled labor. No particular or specialized talents are required for establishing the system within a facility.

Because there is no rigid connection evoked with the magnetic interaction of the panel supporting strip magnets and an associated panel support surface, the panels inherently will accommodate for any temperature induced expansion or contraction phenomena.

Other objects of the invention will, in part, be obvious and will, in part, appear hereinafter. The invention, accordingly, comprises the apparatus and system possessing the construction, combination of elements and arrangement of parts which are exemplified in the following description.

For a fuller understanding of the nature and objects of the invention, reference should be had to the following detailed description taken in connection with the accompanying drawings.

DETAILED DESCRIPTION OF THE INVENTION

While the wall system and modular wall components of the invention enjoy a broad flexibility in terms of the decor or esthetic effect which they present, the resultant wall assembly is quite structurally robust. Each wall module has a width, for example, of 32 to 36 inches and a height of eight feet or more and is formed of eighteen gauge steel. Notwithstanding, the inherent weight and structural integrity, the resultant wall surfaces may exhibit artistry, for example, providing scenes, advertising or graphics. This artistry can be changed or maneuvered from one position to another such that a merchant may evoke a different visual experience for the customer, for example, as conveniently as on a yearly basis. When the wall structure is totally self standing, for example, defining a wall periphery within a preexisting building space, the verticality of the walls is established by, in effect, turning comers, an arrangement wherein certain of the modules will be attached to others at a right angle or some other desired angle. In general, while modular flexibility is provided, the modules themselves are custom produced in a factory setting for any given customer. However, those produced modules will retain the flexibility of carrying utilities such as electrical power, lighting and low voltage communication raceways. Typically one side of each module will support a relatively thin panel which is retained in a vertical orientation by strip magnets which are adhesively adhered to the inward surface of the panel about there inwardly facing periphery. Because these thin panels, i.e., 3/16 inch to about 1/4 inch thickness, are maintained in a vertical orientation, they are retained in a material compressive state, in effect, being supported along their lower edge. With such support, the relatively light attachment achieved with strip magnets is all that's required to maintain this verticality and thus support a portion of the panel weight at the noted lower edge. Vertical orientation support by the magnets permits easy erecting and removing the panels. However, experience with the panels shows that a substantial amount of magnet surface area is derived with a strip magnet approach to attachment. Because the magnets are attracted to a flat surface, temperature related expansion or contraction is inherently accommodated for. The robustness of the wall modules also permits the supporting of doors and any of a variety of implements.

Figure 1:
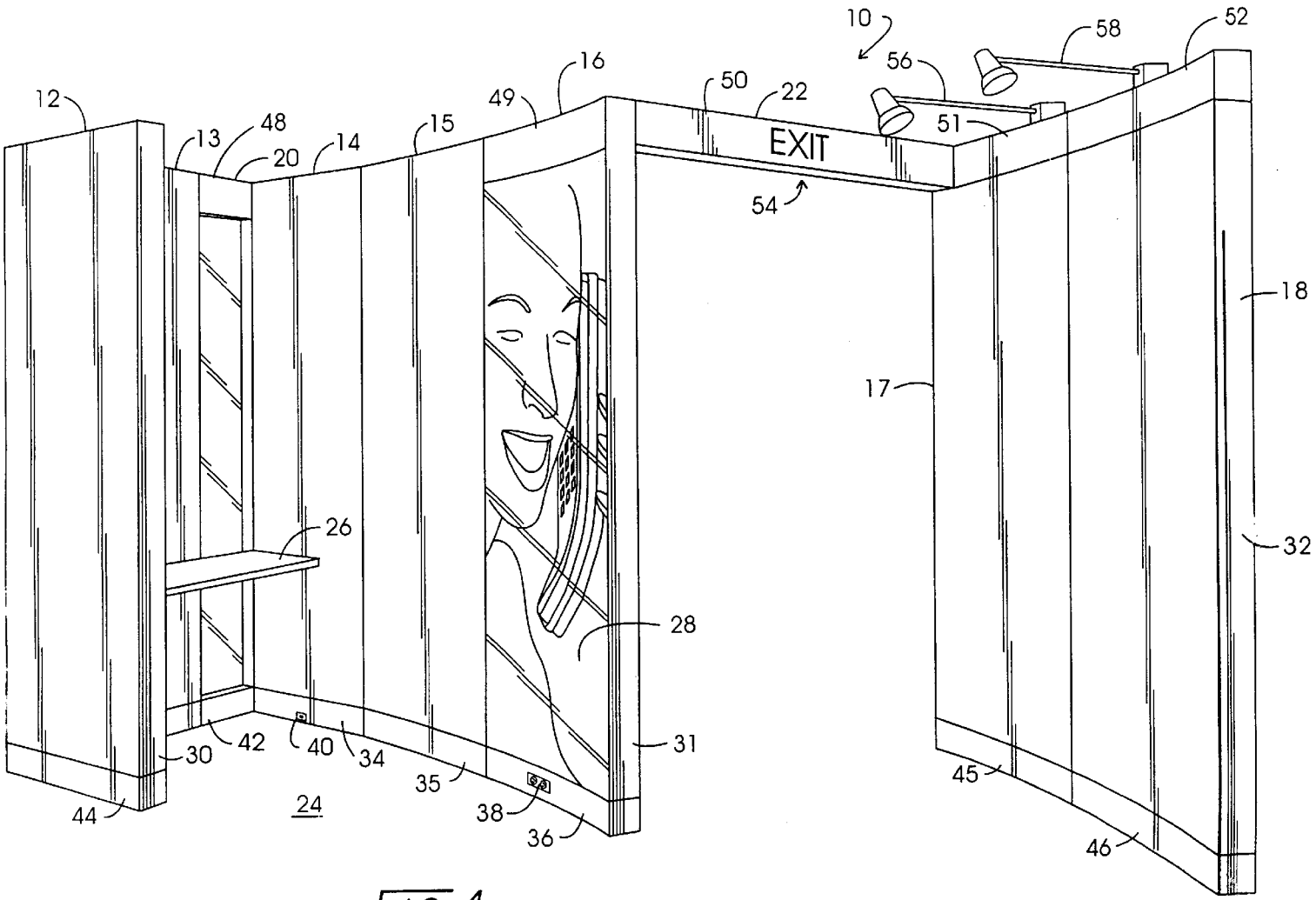
FIG. 1 is a pictorial representation of one modular wall system design of the invention.

Referring to FIG. 1, a portion of a wall system according to the invention is represented generally at 10. System 10 is formed as a sequence or series of wall modules 12–18 of somewhat standardized dimension which are combined with two customized components, a window supporting module 20 and an overhead beam connector module 22. Modules 12 and 13 are interconnected at a right angle while modules 13 and 20 are coupled in a straight wall defining side-to-side arrangement. However, one side of window module 20 and module 14 again are seen to be connected to define a right angle. Thus, as positioned upon a floor 24, the slightly privatized region also provides structural support for system 10. Within that privatized region defined between modules 12 and 14, for example, a shelf as at 26 may be mounted to support a computer, telephone equipment or the like.

Wall module 15 is seen to be connected in a side-to-side manner with module 14 and is configured with a curvature to provide an architecturally pleasing effect. Similarly, the wall module 16 is curved and connected in side-to-side fashion with module 15. In the arrangement shown, the thin magnet supported panels are positioned in an inward sense, the panel 28 attached to module 16 being formed as an optically transparent polymeric sheet carrying a light transmissible display image. The internal cavity incorporated within module 16 carries a light generating fixture extending vertically and providing a backlit display with respect to panel 28. The panel 28 may be provided as a laminar polymeric structure formed, for example, of a thermoplastic polycarbonate condensation product of disphenol-A and phosgene sold under the trade designation "Lexan". Wall modulse 17 and 18 similarly are formed with a curvature and are connected in side-to-side fashion. The exposed ends or sides of the wall modules may be covered with a magnetically attached end panel of thin dimension, three such end panels being represented at 30–32.

The lower, floor 24 engaging region of each of the panels a modular wall panel is formed having a base support assembly each of which contains a lower utility channel which are inter communicative from wall module to wall module. These base support assemblies are covered with a baseboard which, preferably, is at least partially magnetically attached to the wall modules. Such baseboards may be of a singular length for a given pattern of wall modules or one may be provided for each wall module. The baseboards preferably extend not only along the panel side for removable access to the utility channel, but also are employed at the rearward side or back support side of the panels both for aesthetic reasons and for protecting the lower regions of those back surfaces of the modules from commercial cleaning equipment and the like. Accordingly, baseboards may be seen at 34, 35 and 36 at the bottom regions of respective wall modules 14–16. The noted utility channels preferably are divided into an upwardly disposed base line raceway channel for providing a.c. line current and electrically supporting such components as electrical outlet 38. Additionally, an auxiliary raceway may be provided below that base line raceway for carrying low voltage communication lines, an outlet for such a low voltage function being represented at 40 extending through baseboard 34. Additional baseboards are shown at 42–44 in connection with respective modules 20, 13 and 12. It may be noted that baseboard 44 extends beneath the side panel 30 and is positioned rearwardly of the panel supporting face of module 12. In similar fashion baseboard 36 extends beneath the side surfacing panel 31. Baseboards also are seen at 45 and 46 located beneath the panel supporting sides of wall modules 17 and 18, baseboard 46 being shown extending beneath the side panel 32. Access to the noted utility channel is provided at that side of each wall module carrying the large panel structure. Each of the wall modules further incorporate an upper support assembly which also may carry a utility channel which is, for example, in electrical communication with the lower utility channel via vertical raceway channels. For certain of the wall module designs, this upper raceway is covered with a magnetically attached small upper panel, for example, as at 48 in conjunction with module 20; 49 in conjunction with wall module 16; 50 in conjunction with beam module 22; 51 in conjunction with wall module 17; and 52 in conjunction with wall module 18. The upper raceways or utility channels provide electrical circuit inputs to lighting fixtures within module 16, as well as to modules 22, 17 and 18. The magnetically supported panel 50 positioned upon beam module 22 is seen to carry an illuminated exit sign represented generally at 54. Upper raceway channels within modules 17 and 18 are seen to support overhead light fixtures shown respectively at 56 and 58. These fixtures will illuminate a design or artistic presentation retained by the associated wall panels.

Figure 2:
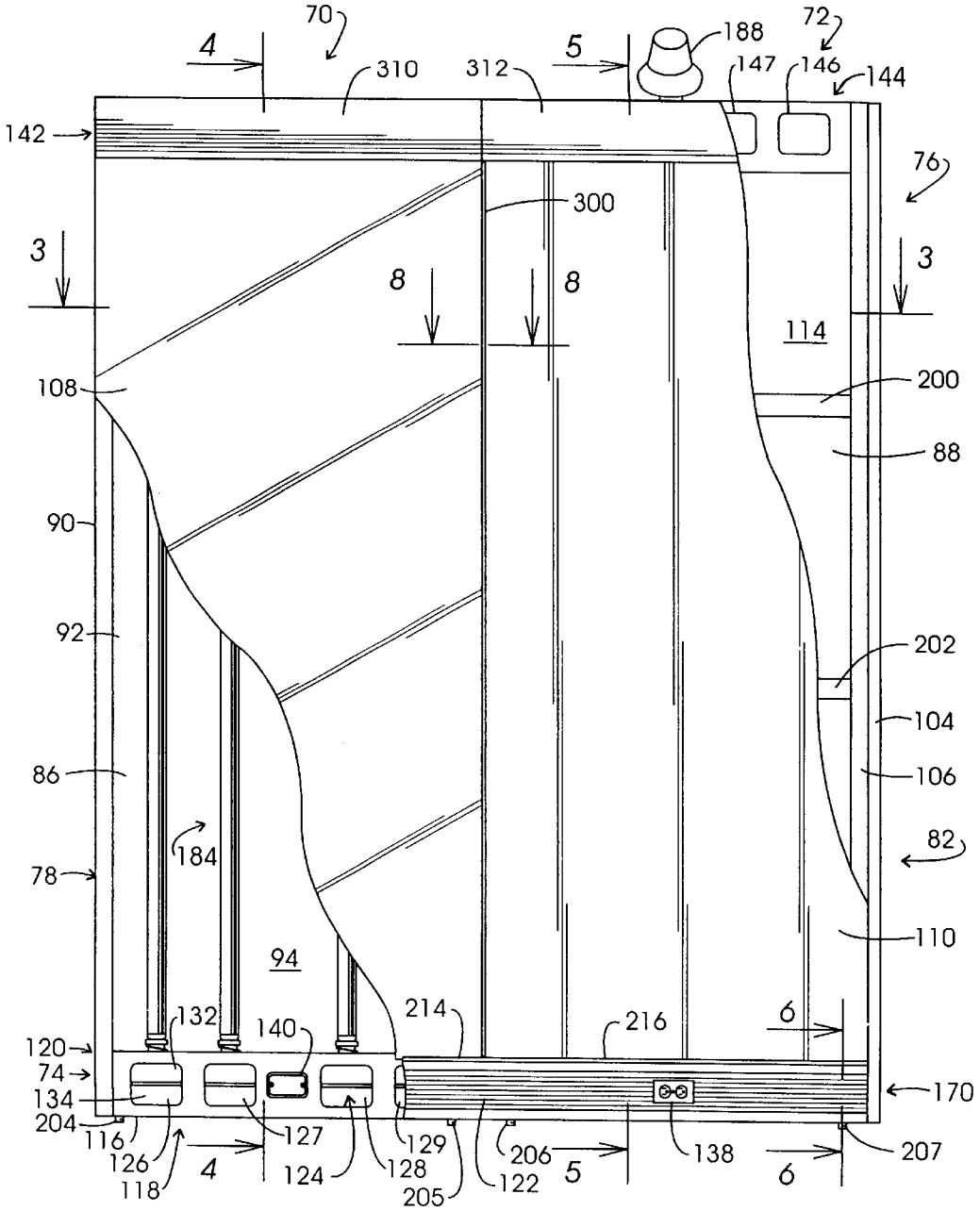
FIG. 2 is a front view of adjacently coupled wall modules according to the invention with portions broken away to reveal internal structure.

Referring to FIG. 2, the structure of two side interconnected wall modules represented generally at 70 and 72 is revealed, the figure looking into the panel covered sides of each of these modules. Wall modules 70 and 72 includes an upstanding support module represented respectively at 74 and 76. Each of the support modules 74 and 76 are formed having two generally vertically oriented support components which are connected and preferably intricately formed with a back support and are mutually spaced apart in generally parallel relationship a module widthwise extent. That widthwise extent is selected to support a panel about the edges. In the figure, one side support component for support module 74 is shown in general at 78, while an oppositely disposed side support component for support module 76 is seen in general at 82. It may be noted from a drawing that the wall module 72 is formed with a curvature similar, for example, to wall module 16 as shown in FIG. 1.

Figure 3:
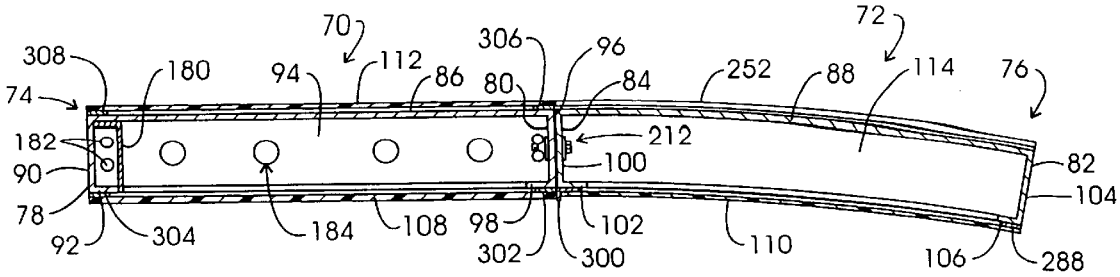
FIG. 3 is a sectional view taken through the plane 3—3 in FIG. 2.

Looking additionally to FIG. 3, it may be seen that support module 74 is formed with a side support component 80 spaced from side support component 78. These side support components 78 and 80 are integrally formed with a back support 86. In similar fashion, support module 76 includes a side support component 84 arranged parallel to component 82 and formed integrally along with support component 82 with a back support 88. FIG. 3 further reveals the curvature of wall module 72 and that side support component 78 is configured having a web 90 and an integrally formed flange 92 which serves as a forward panel support surface. In this regard, the material forming the support module 74 is magnetically responsive, for example, being formed of sheet steel. The term "forward" is used herein in the sense of being that portion of a support module which is open so as to provide access into an internal cavity such as that shown at 94 in connection with wall module 70. The opposite side support component 80 is similarly formed with a web 96 and forwardly disposed flange 98. Flange 98 provides another vertically disposed magnetically responsive forward panel support surface and, along with web 96, is integrally formed with the back support 86.

In similar fashion, side support component 84 is formed with a web 100 and flange 102. Flange 102 functions to provide a vertically disposed magnetically responsive forward panel support surface which is flat. Correspondingly, the side support component 82 incorporates a web 104 and flange 106, the latter also providing a magnetically responsive flat vertical panel support surface. It may be noted that the curvature for the wall module 72 as provided, inter alia, by a curvature formed in the back support 88. A thin, polymeric panel 108 such that is described at 28 in connection with FIG. 1 is positioned vertically against the support module 70. In similar fashion, an opaque panel 110 is positioned against the forward face of support module 76. Note in FIG. 3 that panel 110 is depicted having a lesser thickness than panel 108 and provides removable access to an internal cavity represented generally at 114. For the instant demonstration, the outwardly exposed surface of back support 88 of the wall module 72 may be decorated as a conventional wall, for example, by being painted or being provided with a thin covering. However, the wall modules also may support decorative panels along the back supports. For example, a decorative thin panel 112 is seen to be magnetically supported at the ferrous metal back support 86 at wall module 70.

Figure 4:
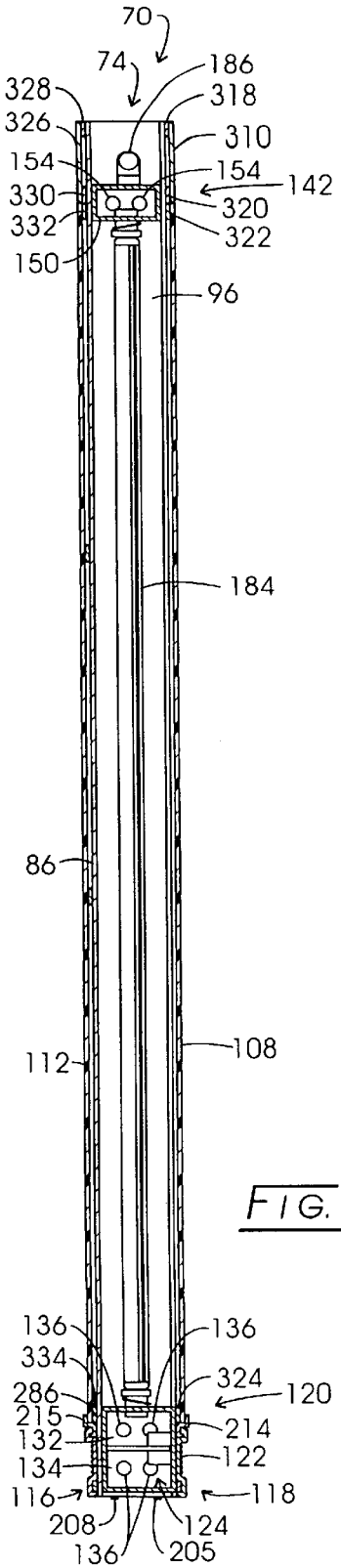
FIG. 4 is a sectional view taken through the plane 4—4 in FIG. 2.

Each of the vertical side support components extends upwardly from a lower portion at which location they are rigidly attached to a base support assembly. In FIG. 2, such a base support assembly is represented generally at 116 extending between the vertical side supports of support module 74. As represented in FIG. 4, this base support assembly is configured with the associated support module 74 as having a square cross section and resembling a box beam. Assembly 116 is seen to extend from a bottom or floor adjacency location represented at 118 to an upper support location as represented generally at 120. The latter location may be employed, inter alia, to support a baseboard utilizing one of a number of available attachment techniques permitting facile removal of the baseboards for accessing internal utilities. Such a forward baseboard is represented at 122. The base support assembly 116 is formed of magnetically responsive material, for example a ferrous metal such as sheet steel. Assembly 116 encloses a utility channel represented generally at 124 which is accessible from forward facing access openings three of which are seen in FIG. 2 at 126–129. FIG. 4 reveals that the channel 124 is configured having an upwardly disposed base line raceway channel 132 which is configured to carry line electrical leads from a utility, while immediately beneath the channel 132 is an auxiliary channel 134 which, for example, carries low voltage lines for communication and the like. Punch-out type openings extend through the web portions of all side support components so as to provide the electrical communication from one wall module to the next adjacent one. Such punch-out type openings are shown in FIG. 4 at 136. The line raceway channel 132 supports a variety of implements including, for example, a conventional electrical outlet as at 138 extending through the baseboard 122. Similarly, an electrical box for supporting such an outlet is seen at 140. In general, polymeric grommets or the like are positioned within the openings 136 to protect wiring.

The upper portions of each of the side supports of the support modules are similarly connected to circular upper support assemblies. Such an upper support assembly is shown in general at 142 in FIG. 4 with respect to the support module 74 and at 144 in FIGS. 2 and 5 with respect to support module 76. These upper support assemblies are rigidly attached to the vertical side supports, for example, by welding and, are provided with access openings. Two such access openings are shown at 146 and 147 in FIG. 2 in connection with support assembly 144. The flat forward or outward surface of the assembly 144, being magnetically responsive sheet steel, provides a connecting face or surface for the magnet coupling of the panels as at 110.

Figure 5:
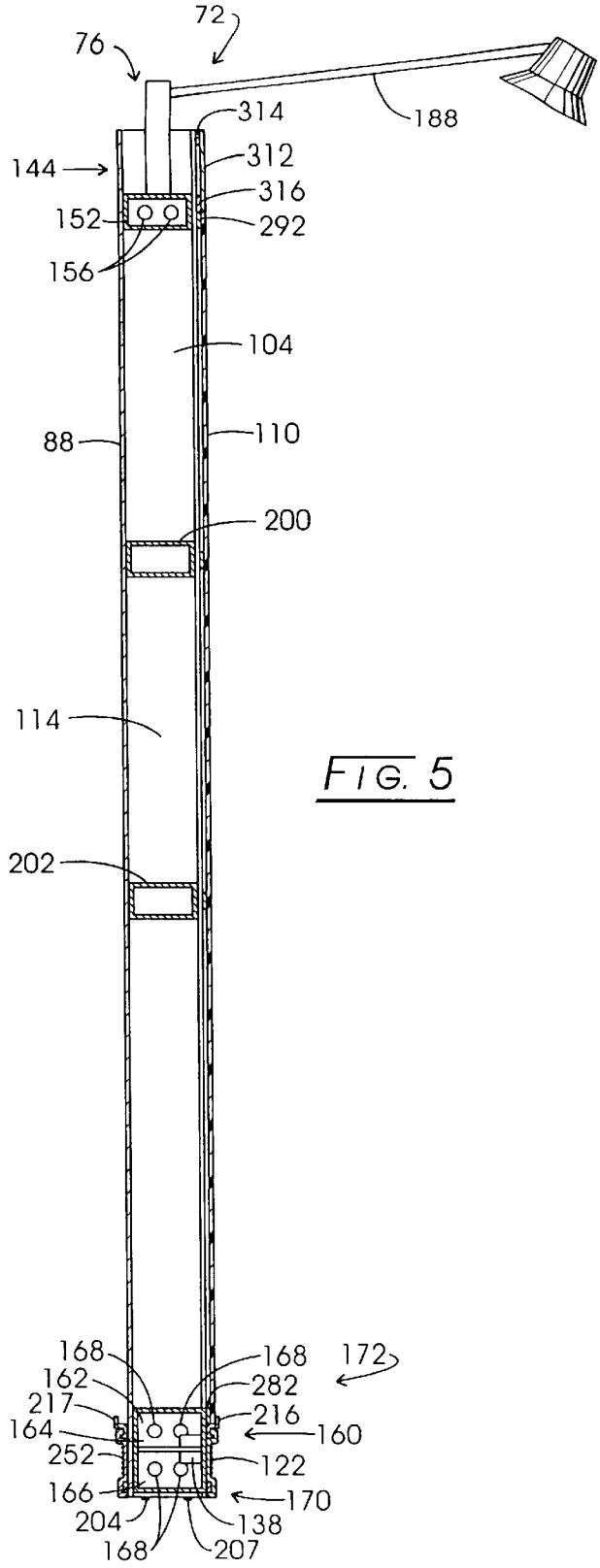
FIG. 5 is a sectional view taken through the plane 5—5 in FIG. 2.

FIGS. 4 and 5 reveal that the upper support assemblies 142 and 144 are configured incorporating upper line raceway channels shown respectively at 150 and 152. Channels 150 and 152 carry electrical utility lines for supporting electrical appliances and the like. As in the case of the lower support assemblies, communication from one wall module to a next adjacent one is provided by knock-out openings holes two of which are shown in FIG. 4 at 154 extending through web 96 and two of which are shown in FIG. 5 at 156 extending through web 104. The latter figure additionally shows a cross sectional view of the base support assembly 160 of support module 76. As in the configuration of base support assembly 116, the assembly 160 extends between the side supports 82 and 84 of support module 72 (FIG. 3) and is weldably connected therewith. The support 160 also is formed having the curvature associated with support module 72 as does the upper vertical support 144. Assembly 160 includes a utility channel represented generally at 162 which, when the wall modules 70 and 72 are interconnected as shown in FIGS. 2 and 3, will be aligned with the utility channel 124 of support module 74. Utility channel 162 is similarly structured having an upper base line raceway channel 164 for supporting conventional utility cables and a low voltage auxiliary raceway channel 166 intended for supporting lower voltage communication cable and the like. Punch-out type openings as at 168 are provided within the web 114 for providing utility channel communication with any next adjacent connected wall module. The base support assembly 160, as before, extends from a floor adjacency location 172 to an upper support location 172, and provides a magnetically responsive, ferrous metal surface to support magnet attachment of baseboard 122.

To provide electrical communication between the utility channels at the baseboard assemblies and the channels at the upper support assemblies, vertical raceway channels may be provided at select vertical support components. FIG. 3 reveals one such vertical raceway channel with respect to module 74 at 180. Communication with the base line raceway channel 132 (FIG. 4) is provided by knock-out openings, two of which are represented at 182. With the arrangement thus shown, electrical line communication or continuity readily is established between a base support assembly and an associated upper support assembly. Such an arrangement provides operational support, for example, for the array of florescent light generating tubes represented generally at 184 in FIGS. 2–4 which function to provide back lighting for a display at panel 108. The upper support assembly utility channel 150 additionally is seen to provide power for a horizontally disposed florescent tube fixture 186 as seen in FIG. 4. The lighting thus provided functions as a ceiling illuminating indirect light arrangement. As represented in FIGS. 2 and 5, direct lighting from overhead can be supported from the upper support assembly channel, for example, as provided at light fixture 188.

The modular wall system of the invention has an important use in retail and service environments where the public is invited to positions of adjacency with the wall modules, whether standing, walking or sitting. A typical member of the public will have a tendency to lean at the shoulder height against an opaque wall or, when sitting, to touch or strike a wall at a wainscot location. However, the psychological tendency for such members of the public is not to lean against or strike a flat display of art, graphics or similar types of information, for example, as represented at backlit panel 28 shown in FIG. 1 or similarly backlit panel 108 shown in FIG. 2. Where the modular wall structures are configured to establish a wall periphery utilizing opaque panels as at 110 shown in FIG. 2, then cross supports are provided which are fixed between the oppositely disposed side supports at an elevation above the floor or height effective to structurally support the flat module panel against force asserted upon panel forward surface by the shoulder of a standing adult human, for example, at a level of about 4½ to 5 feet. Such a cross support is shown in FIGS. 2 and 5 at 200. Formed of magnetically responsive material such as a ferrous metal, the forward face or surface of the cross support 200 is flat for providing abutting engagement with the rearward surface of the panel such as that of 110. Preferably, a strip magnet is interposed between the rearward face of the panel 110 and the forward face of cross support 200. In similar fashion, a cross support 202 is positioned at a typical wainscot height, i.e., at about an elevation of 30 inches above the floor. As the case of support 200, the support 202 is weldably fixed to the oppositely disposed side support of the support module and presents a flat forward surface or face for abutting engagement with a panel such as that at 110. A strip magnet preferably is interposed between the rearward surface of the panel 110 and that forward face of the cross support 202. Such strip magnets are adhesively attached to the panel.

Erecting a peripheral wall structure utilizing the wall modules as at 70 and 72 involves initially moving the support modules into juxtaposed position upon the floor of a facility. The support modules then are leveled using threaded leveling assemblies seen protruding from the floor adjacency locations 118 and 170 represented in FIG. 2. The leveling assemblies may be implemented as paired machine screws or bolts the tips of the forwards ones of which are seen in FIG. 2 at 204–207. A corresponding set of leveler assemblies is provided immediately adjacent and rearwardly of assemblies 204–207, two of which are revealed in FIGS. 4 and 5 respectively at 208 and 209. The support modules are structurally robust and self supporting on the floor in which they are positioned. They are maintained in adjacency and inter-coupled by the simple expedient of interconnecting adjacent surfaces with relatively light bolt, washer and wingnut assemblies. FIG. 3 reveals one such wingnut arrangement interconnecting support modules 74 and 76. In this regard, a bolt, washer and wingnut connection is shown in FIG. 3 in general at 212 coupling the side or web 80 of support module 74 with the side or web 84 of the support module 76. Typically, three or four such nut and bolt assemblies are employed for this connection.

Upon completion of the positioning, leveling and interconnecting of support modules, for example, as at 74 and 76, the removable baseboards, main panels and upper panels are installed along with selected utilities and appliances. In a preferred arrangement, both main panels and baseboard are partially mounted utilizing a horizontally disposed panel lower support which extends between the side supports adjacent the upper support locations shown respectively in FIGS. 4 and 5 at 120 and 172. In this regard, FIG. 4 reveals oppositely and horizontally disposed panel lower supports 214 and 215, while FIG. 5 reveals oppositely disposed panel lower supports 216 and 217.

Figure 6:
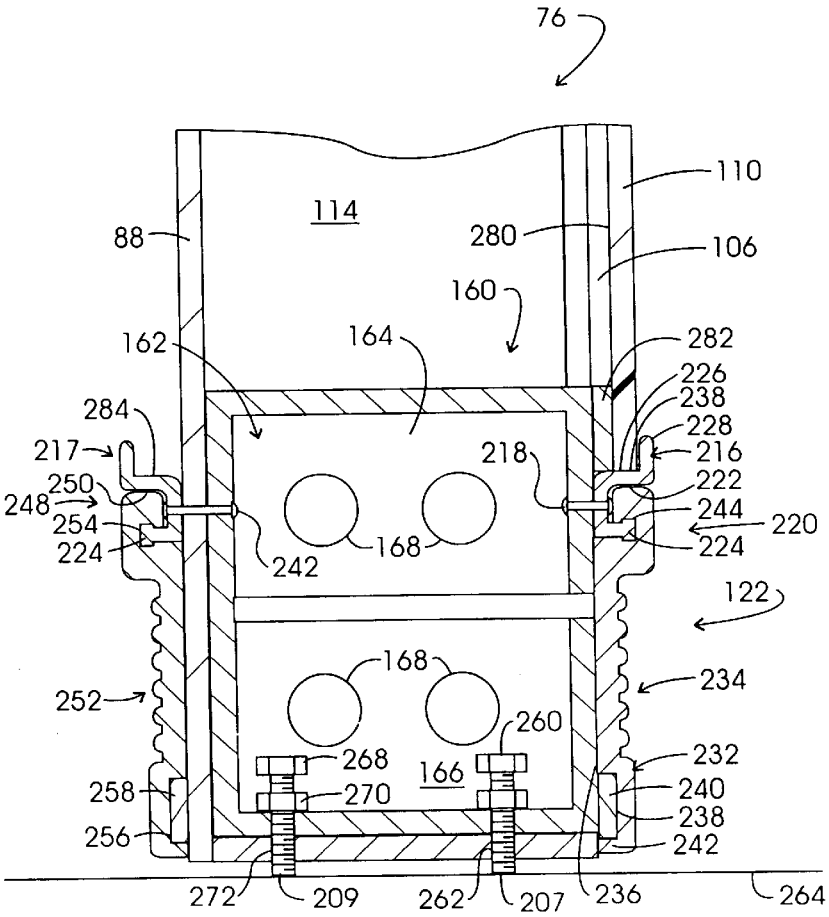
FIG. 6 is a partial sectional view taken through the plane 6—6 in FIG. 2.

Looking to FIG. 6, the structuring of the panel lower support and particularly those at 216 and 217 is revealed in cross-sectional detail. Support 216 is connected between the side support components with an array of rivets extending into base support assembly 160, one such rivet being shown at 218. The support 216 is formed having a baseboard connector assembly shown at 220 which is of generally U-shape to define an elongate horizontally disposed receiving cavity 222, one leg of which is a forwardly protruding, I-shaped engaging stud or component 224 having an enlarged elongate outwardly disposed head. The opposite leg of the receiving cavity 222 forms an outwardly extending upwardly disposed platform 226 which in combination with an outwardly extending elongate horizontal leg 228 defines an upwardly opening channel for receiving the lower edge 230 of panel 110. With the arrangement, the platform 226 then supports the weight of that panel which is not accommodated by magnetic coupling with the support modules 76. Baseboard 122 is configured of a flexible polymeric material which is formed by extrusion with a forward face 232 containing an array of serrations represented generally at 234 which minimize scuffing and the like caused by commercial cleaning equipment. Rearward face 236 of baseboard 122 is generally flat but includes a lower open channel 238 within which a flexible strip magnet 240 is adhesively retained. The inwardly disposed surface of magnet 240 magnetically engages the baseboard lower support surface 242 provided as a portion of the forward surface of base support assembly 160. A baseboard connector assembly component is provided as a horizontally extending receiving cavity 244 which is configured for positioning over the engaging stud 224 of panel lower support 216. With the arrangement shown, the access openings within the assembly 160 are covered by baseboard and the baseboard is readily removed from the wall module by hand to provide, for example, access into the internal utility channel.

For most implementations of the wall system, a given wall module will also be provided with a rearward face baseboard. Accordingly, in FIG. 6, panel lower support 217 is seen connected through the base support assembly 160 and back support 88 by an array of horizontally disposed rivets, one of which is seen at 246. Support 217 is identical to support 216, containing a U-shaped baseboard connector assembly represented generally at 248 having a receiving cavity 250 functioning to receive the top edge of a flexible polymeric baseboard represented generally at 252. An elongate horizontally disposed engaging stud 224 extends outwardly to receive and connect with a corresponding receiving cavity 254 formed within the rearward face of baseboard 252. The rearward face of the baseboard 252 additionally includes a channel 256 within which a flexible strip magnet 258 is adhesively secured. Magnet 258 forms a lower connector which magnetically engages the rearward surface of back support 88. With the arrangement shown, the baseboard 252 readily is installed and removed by the user.

FIG. 6 illustrates the leveling assemblies 207 and 209 at a greater level of detail. For example, assembly 207 includes a machine screw 260 which is threadably engaged within a threaded bore 262 formed within the bottom of base support 160. To retain the screw 260 at a proper position in engagement with a floor shown at 264, a locking nut 266 is provided which engages the lower surface of assembly 160. In similar fashion, the leveling assembly 209 includes a machine screw 268 which is threadably engaged within a bore 272 to be adjustably engaged with floor 264 and which is locked in position by locking nut 270.

Returning to panel lower support 216, wherein the lower edge 230 of panel 110 is compressibly engaged in a vertical orientation with platform 226, it may be observed that the rearward face 280 of the panel 106 supports another adhesively attached magnetically responsive panel connector component implemented as a strip magnet 282 formed identically as strip magnet 240. The strip magnet 282 extends along the lower edge 230 of panel 110. It is magnetically attracted to the forward facing upper surface of the base assembly 160.

Where a panel is applied to the back support, for example, as shown in connection with FIG. 3 where a rearward panel 112 is magnetically attached to back support 86, then as shown in FIG. 4, panel 112 is compressibly supported by panel lower support 215. Note that the lower edge of panel 112 is positioned for support upon a horizontal platform thereof corresponding with that described at 226 in FIG. 6. Such a platform at the back support is shown in the latter figure at 284 in conjunction with panel lower support 217. In similar fashion as panel 110, panel 112 incorporates a horizontal magnetically responsive connector at its lower edge which is implemented as a flexible strip magnet adhesively connected to the rearward face of panel 112. That strip magnet is shown at 286 in FIG. 4.

The preferred arrangement of the wall system is one wherein the strip magnets are adhesively attached to the rearward face of both the main panels as well as the upper panels. A preferred type of strip magnet is a high energy magnet which is a composite of strontium and/or barium ferrite particles oriented within a thermoplastic polymer matrix. The magnets having a width of about one inch and a thickness of about 0.060 inch with an adhesive backing are preferred. Such magnets are available at energy values of 1.2 MGOe or 1.4 MGOe and are marketed, for example, by MSI, Inc. of Marietta, Ohio.

Figure 8:
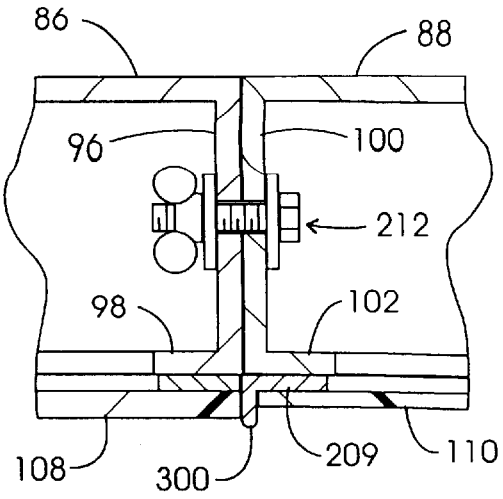
FIG. 8 is a sectional view taken through the plane 8—8 in FIG. 2.
Figure 7:
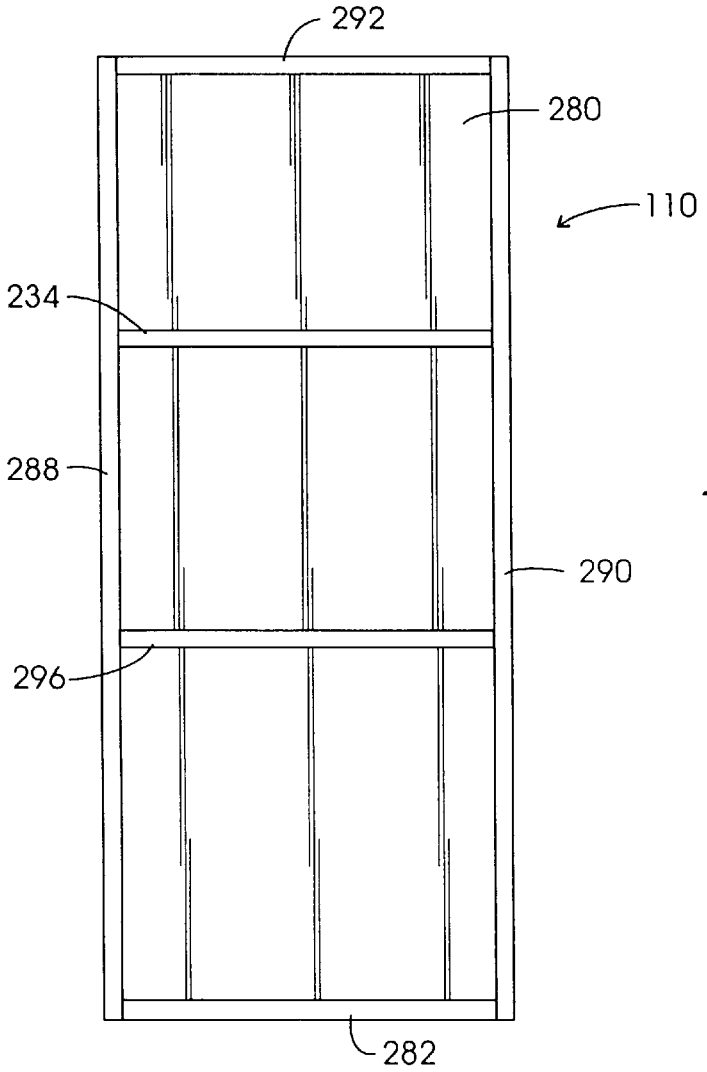
FIG. 7 is a rear view of a panel according to the invention.

Looking to FIG. 7, the pattern of attachment of the magnet strips, for example, upon the rearward face 280 of panel 110 is revealed. Lower edge magnet strip 282 reappears. It is combined with vertical strip magnets 288 and 290 extending adjacent the edges of the panel 110 and an upper strip magnet 292 extends adjacent the upper edge of panel 110. Two cross strip magnets shown at 294 and 296 are adhesively attached to the rearward surface 280 at locations for engagement with the earlier described cross supports shown respectively at 200 and 202 in FIGS. 2 and 5. Strip magnet 290, for the embodiment shown, is a panel connector component which is located at one panel edge and which has a generally "L" shape which provides a bead which extends forwardly around the edge of the panel 110. Looking to FIG. 8, the modified strip magnet is illustrated. Note that the connector includes a rearward surface which is in contact with flange 102 and extends forwardly about the edge of panel 110 to define a bead 300. This bead 300 achieves what may be called an "expositial transition" which is particularly useful where panels of greater and lesser thickness are juxtaposed. Such an arrangement is shown in FIG. 8 in connection with panels 108 and 110 which are adjoin the bead 300.

Vertical strip magnets which are adhered to the rearward surface of panel 108 at its vertically standing edges are revealed in FIG. 3 at 302 and 304. Correspondingly, strip magnets 306 and 308 are seen attached to the rearward face of panel 112 in that figure. Strip magnets also are applied about the four edges of panels applied to the outside surfaces of ends or web components of the wall module as described at 30 and 32 in FIG. 1. While the main panels may extend to the very top of a given support module, it is convenient to provide top panels which are hand removable by virtue of their magnetic connection to the upper support assemblies to provide access to utility channels and the like. These panels are formed having strip magnets adhered to their rearward surfaces about their peripheral edges. FIG. 2 reveals such an upper or top panel 310 attached to support module 74 and an upper or top panel 312 magnetically attached to support module 76. Top or upper panel 312 reappears in FIG. 5 in connection with horizontally disposed strip magnets 314 and 316 positioned for magnetic attachment with the upper support assembly 144. Upper or top panel 310 is shown in FIGS. 4 coupled to upper support assembly 142 by magnet strips including those shown at 318 and 320. The figure also shows horizontally disposed strip magnets 322 and 324 located at the respective top and bottom edges of forward panel 108. FIG. 4 also shows an upper or top panel 326 magnetically attached to back support 86 by strip magnets including those shown at 328 and 330, while the horizontally disposed strip magnets associated with the top and bottom edges of rearward panel 112 are shown respectively at 332 and 334 magnetically coupled with the back support 86.

Figure 9:
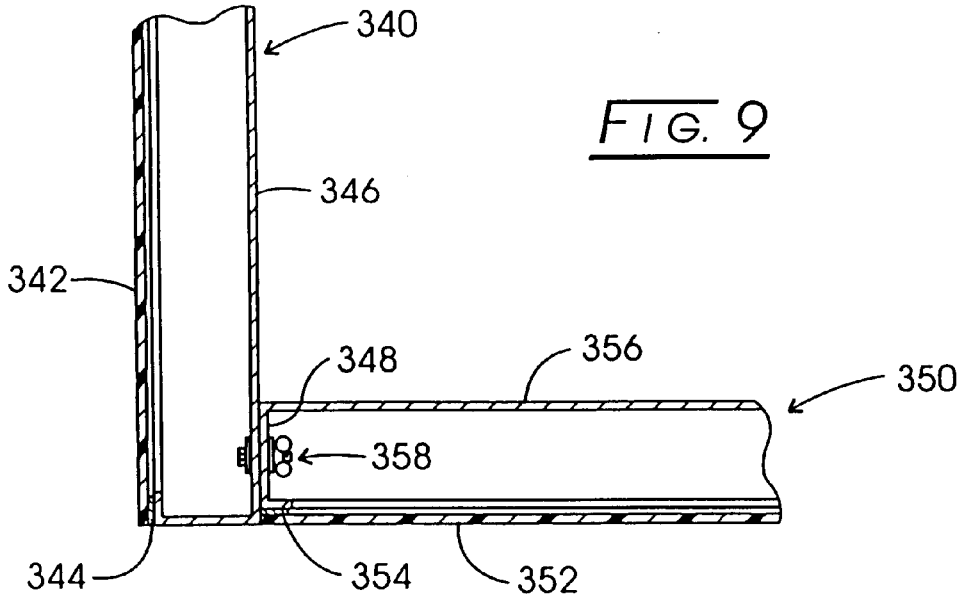
FIG. 9 is a partial sectional view showing the connection of a side of one wall module with a rear back support of another wall module.
Figure 10:
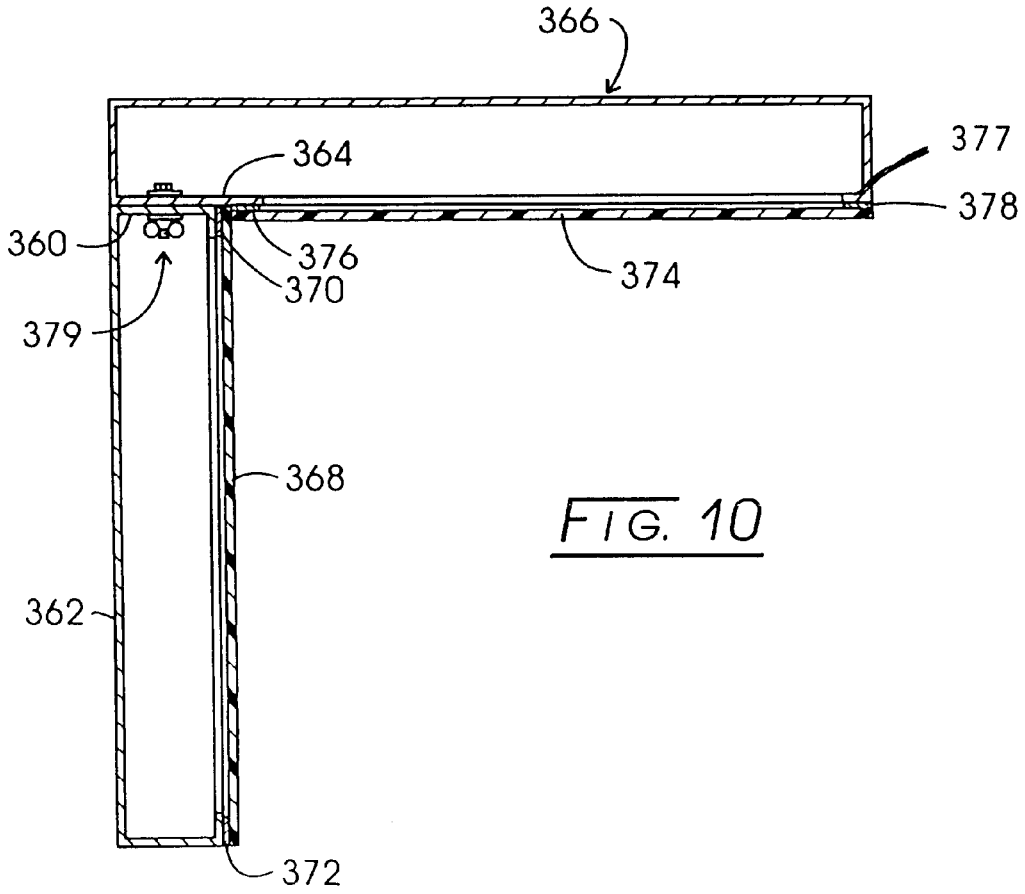
FIG. 10 is a sectional view showing the connection of the side of one module with a forward flange of another module.

The wall modules of the wall system are individually structurally robust, exhibiting a wall strength greater than a conventional commercial studded wall. To maintain them in a free standing orientation requires only fasteners of substantial simplicity, for example, the bolt-washer-wingnut assembly as described in 212 in numbers of three or four for each attachment. Looking to FIG. 9, a sectional view of a right angle attachment wherein the side or web of one wall module is connected to the back support of another is provided. In the figure, a wall module 340 having a forward panel 342 magnetically affixed thereto by magnet strips as at 344 is coupled at its back support 346 with the web or side 348 of a wall module 350. Module 350 is seen to have a forward panel 352 affixed thereto by strip magnets, one being shown at 354. The back support 356 of wall module 350 is integrally formed with the web 348 and modules 340 and 350 are interconnected by three or four bolt-washer-wingnut assemblies one being shown at 358. The attachment shown in FIG. 9 also may be employed, for example, in attaching the beam module structure 54 shown in FIG. 1 with the back of wall module 16. Further in this regard, the upper panel 50, carrying the exit sign 54, is configured in the manner of module 350 including panel 352 and magnet strip 354. Preferably, magnet strips are adhered to the rearward surface of the panel 50 about all four edges. The opposite connection of the beam module 22 with wall module 17 will have appearance similar to the connection shown in FIG. 10.

Where the side of one wall module is coupled with the forward surface of another wall module, an adaptation preferably is made with respect to the former. That adaptation provides for increasing the width of one flange and corresponding increasing the width of the wall module to accommodate the enlarged flange. Looking to FIG. 10, such a connection is revealed wherein the side support web or side 360 of a wall module 362 is coupled with the enlarged side component flange 364 of a wall module 366 which is enlarged in it's widthwise dimension. Wall module 362 is shown supporting a forward panel 368 as above-described, such connection including vertically disposed strip magnets 370 and 372. Correspondingly, a forward panel 374 is coupled, inter alia, by vertical strip magnets 376 and 378 to flanges 364 and 377. Connection between wall module 362 and 366, as before, is by three or four bolt-washer-wingnut assemblies, one of which is shown at 379.

Figure 11:
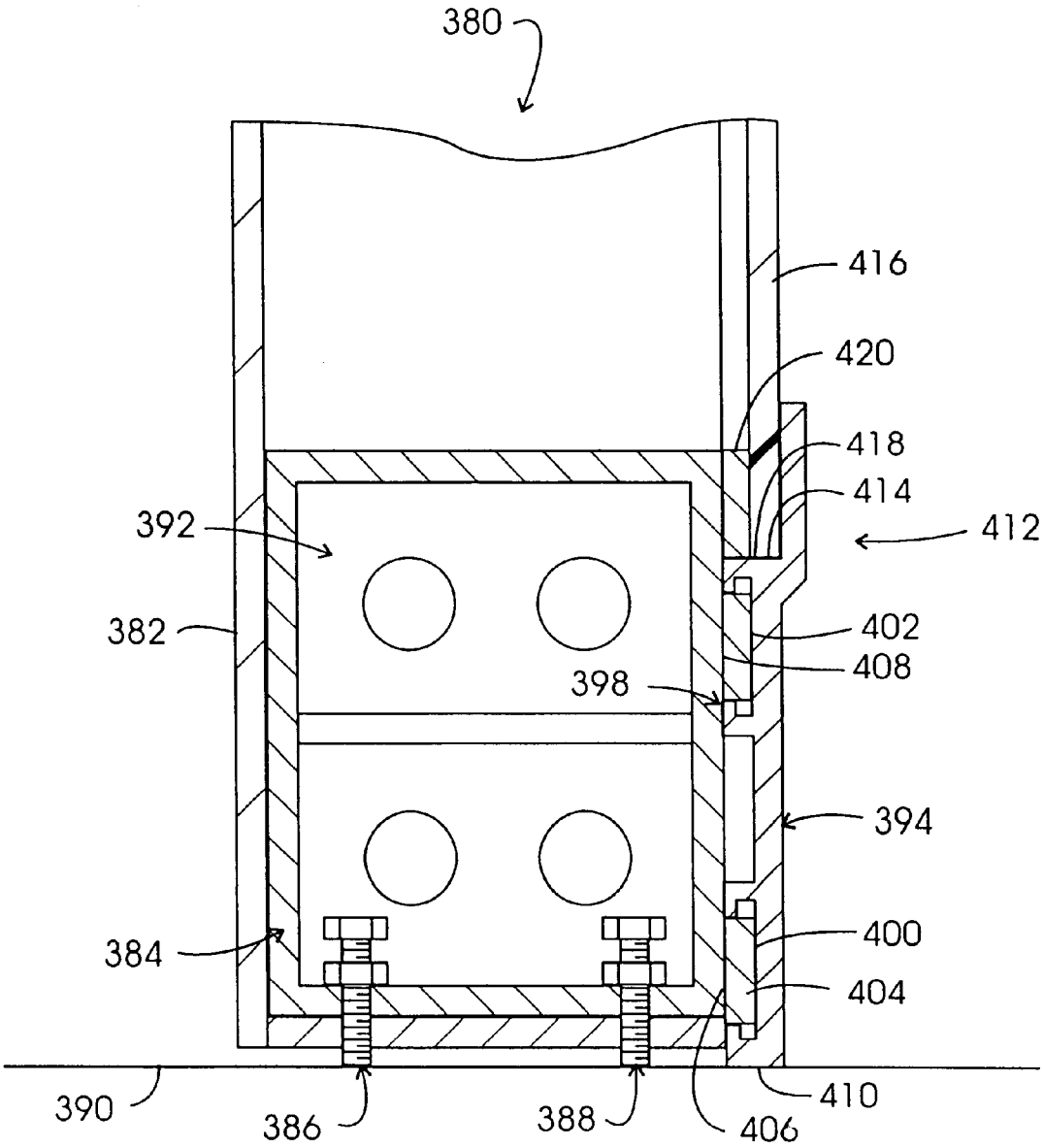
FIG. 11 is a partial sectional view of an alternate baseboard arrangement for the wall module system of the invention.

While the baseboard and panel lower support embodiment of the instant wall system shown in FIG. 6 is the preferred structure, a rigid baseboard, for example, formed as an aluminum extrusion may be employed to incorporate both a baseboard and panel lower support function. Referring to FIG. 11, the bottom region of a wall module is sectionally portrayed in a manner similar to FIG. 6. Represented in the figure is a wall module 380 having a back support 382 to which is rigidly attached a base support assembly represented generally at 384. Leveling screw assemblies 386 and 388 are seen extending through threaded bores within the base support assembly 384 to a supporting contact with a floor 390. The lower utility channel within the base support assembly 384 is shown at 392. A rigid baseboard is represented generally at 394 and is seen to incorporate a forward surface 396 and a rearward surface 398. Formed within the rearward surface 398 are two horizontally extending elongate cavities 400 and 402. Adhesively positioned within cavity 400 is a strip magnet 404 which is magnetically adhered to the baseboard lower support portion or surface of base support assembly 384. Correspondingly, upwardly disposed channel 402 adhesively retains a strip magnet 408 which is magnetically adhered to an upper baseboard support portion or face of the base support assembly 384 shown at 408. Note that the bottom edge 410 of the baseboard 394 is in compressive contact with floor 390 and that the baseboard extends to an upwardly open panel lower support portion represented generally at 412. That portion 412, as before, includes a platform 414 which functions to compressibly support a portion of the weight of panel 416 at its lower edge 418. A strip magnet 420 is shown adhesively attached to the rearward surface of panel 416 which extends horizontally in adjacency with panel lower edge 418 and is in magnetic connection with the upper forward surface of the base support assembly 384.

Figure 12:
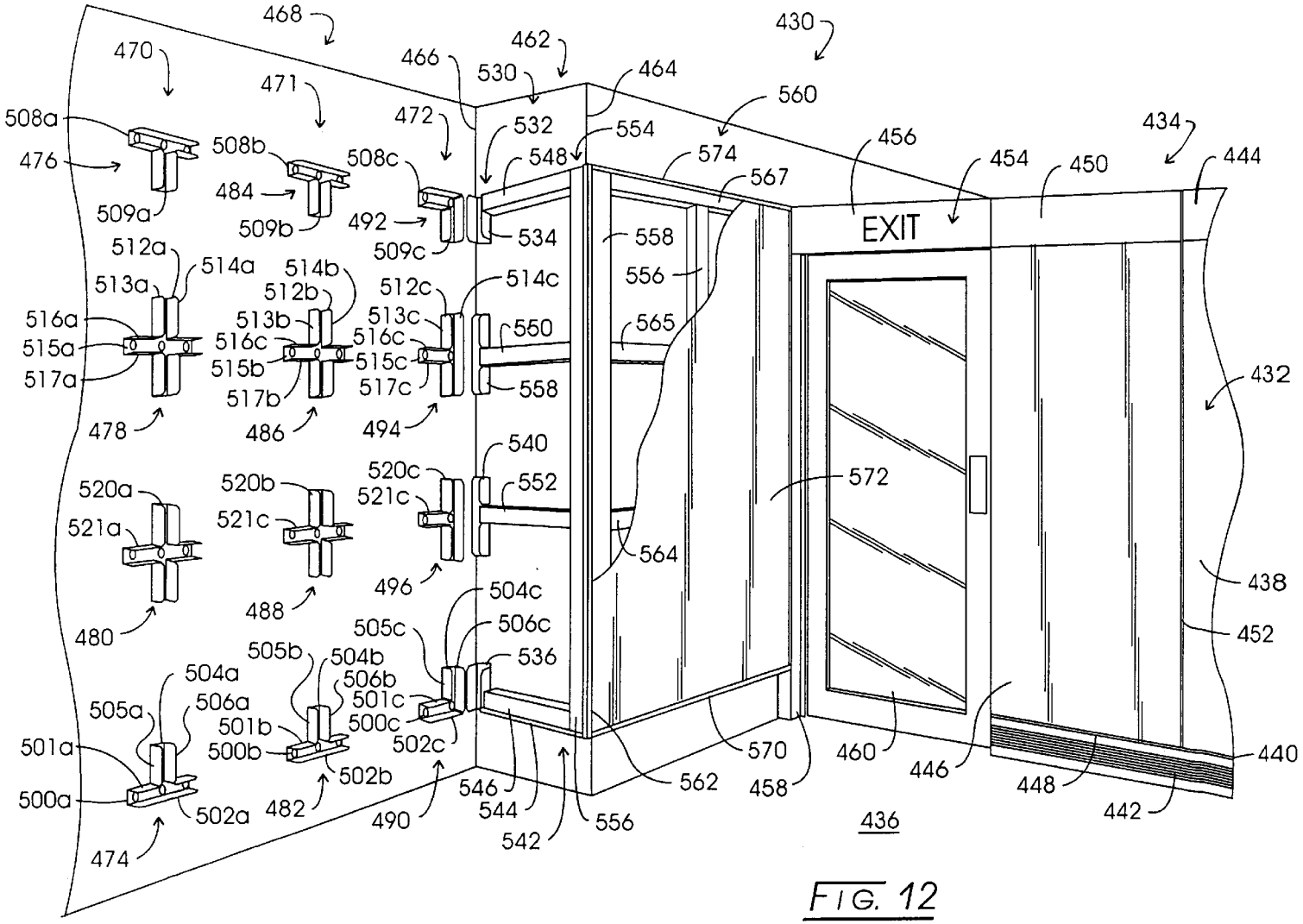
FIG. 12 is a pictorial representation of the wall panel system of the invention.

In addition to providing upstanding peripheral definition within an open interior space, the modules described herein will, from time to time, be associated with a preexisting wall. Thus, a need arises for mounting the compression-magnetically vertically stabilized thin panels to a wall. Such an arrangement of the system is depicted in FIG. 12 and is represented generally at 430. In the figure, a portion of an upstanding wall module as above-described is shown in general at 432 having been connected on a side-to-side basis with a next upstanding wall module 434. Modules 432 and 434 are leveled as above-described and stand upon a floor 436. Wall module 432 is seen to support a thin module panel 438, the bottom edge of which rests against a forward, upwardly opening panel receiving and supporting channel 440 which, in turn, is positioned just above a baseboard 442. Above the panel 438 is a magnetically mounted upper panel 444. Wall module 434 is similarly structured, having a module panel 446 the bottom edge of which resides in another forward, upwardly opening panel receiving and supporting channel 448 also positioned just above baseboard 442. Above the principal panel 446 is a magnetically supported upper panel 450. One panel 446 or 438 carries an L-shaped magnetic strip the forwardly protruding bead or spacer component thereof being shown at 452.

Wall module 434 is connected to an upwardly disposed beam module represented generally at 454 which is configured similarly to that described at 22 in FIG. 1. In this regard, the module 454 magnetically supports a thin panel 456 which carries an illuminated exit sign. Wall module 434, beam module 456 and a jamb 458 support a commercial door 460.

With the present demonstration, the decor evoked with the modular wall system including modules 432 and 434 is continued to a fixed wall represented generally at 462 having what may be termed an outside corner 464 and an inside corner 466. Looking initially to the wall segment represented generally at 468, a starting procedure for the mounting of wall panels is represented. At the wall segment 468, there are seen to be three sequences of vertically aligned attachment brackets identified generally at 470–472. Within the sequence 470 there is provided a bottom bracket represented generally at 474 over which is vertically positioned and aligned a top bracket represented generally at 476. Vertically aligned between brackets 474 and 476 is an upper intermediate attachment bracket represented generally at 478 and a lower intermediate attachment bracket represented generally at 480.

In a similar arrangement, the attachment brackets within sequence 471 include a bottom bracket shown generally at 482. Aligned over this bottom bracket is a top bracket represented generally at 484. Below bracket 484 is an upper intermediate bracket represented generally at 486 and vertically aligned therewith is a lower intermediate bracket represented generally at 488. The attachment brackets of sequence 472 are geometrically altered to accommodate for their proximity to the inside corner 466. As before, however, the sequence includes a bottom bracket represented generally at 490 and aligned over it is a top bracket represented generally at 492. An upper intermediate bracket is represented at 494 and a lower intermediate bracket is represented at 496.

Now looking to the structure of the bracket itself, bottom bracket 474 is seen to have an outwardly extending horizontal bottom flange assembly 500*a* which is positioned at a user selected height above the floor 436. In general, any baseboard structures will remain of a conventional variety, inasmuch as the previously standing walls will contain utilities provided during wall construction or the like. It may be observed, however, that the horizontal bottom flange 500*a* is formed of paired, parallel, spaced apart bracket flanges 501*a* and 502*a* which are formed integrally with and extend outwardly from a base plate which, in turn, is attached to the wall 468. The components of the horizontal bottom flange assembly at bracket 482 are similarly numerically identified but with a "b" suffix. Finally, the L-shaped bracket 490 incorporates a horizontal bottom flange assembly 500*c* with paired parallel flanges 501*c* and 502*c* which are extending only in one direction away from the corner 466.

Bracket 474 further includes a vertical bottom flange assembly 504*a* which extends vertically upward from the middle of horizontal flange assembly 500*a* and includes paired, parallel, spaced apart bracket flanges which extend outwardly from the wall 468 and are revealed at 504*a* and 505*a*. A similar vertical bottom flange assembly is shown at bottom bracket 482, the components thereof being identified with the same numeration but with the suffix, "b". The vertical bottom flange 504*c* for bottom bracket 490 is identically structured and the components thereof are identified with the same numeration and suffix, "c".

Top bracket 476 is structured identically as bottom bracket 474 but is mounted in a vertical reversed sense. In this regard, the horizontal top flange assembly is shown at 508*a*. Assembly 508*a* is configured with outwardly extending horizontal top paired flanges identical to those described at 501*a* and 502*a* in connection with bracket 474. Identical structuring at bracket 484 is shown at 508*b* and the inside corner bracket 492 shows a top horizontal bracket at 508*c*. That bracket is structured essentially identically as assembly 500*c* at bracket 490. Extending downwardly from the horizontal top flange assembly 508*a* is a vertical top flange assembly 509*a*. Assembly 509*a* is configured identically as the vertical bottom flange assembly 504*a*. In similar fashion, a vertical top flange assembly 509*b* extends downwardly from horizontal top flange assembly 508*b* and vertical top flange assembly 509*c* extends downwardly in bracket 492 from the horizontal top flange assembly 508*c*.

Now looking to the upper intermediate bracket 478, a generally cross-shaped arrangement is provided. The vertical component of this shape is a vertical upper intermediate flange assembly 512*a* formed of paired, parallel, spaced apart flanges 513*a* and 514*a*. Similarly, attachment bracket 486 is formed with vertical flanges 513*b* and 514*b* and bracket 494 is formed with vertical flanges 513*c* and 514*c*. The horizontal upper intermediate flange assembly for bracket 478 is identified at 515*a* and is seen to intercept the vertical upper intermediate flange assembly 512*a*. Assembly 515*a* is formed with paired, parallel outwardly extending flanges 516*a* and 517*a*. In similar fashion, bracket 486 is formed with horizontal upper intermediate flange assembly 515*b* and associated flanges, while bracket 494 is formed with a corresponding horizontal upper intermediate flange assembly 515*a* and associated flanges. The elevation of flange assemblies 515*a*–515*c* above the floor 436 may be selected, for example, to accommodate a force imposed upon a wall panel from the shoulder of a leaning human being.

Now looking to the lower intermediate bracket 480, a vertical lower intermediate flange assembly is represented at 520*a*. Assembly 520*a* is structured essentially identically as the assembly 512*a* shown at bracket 478. Similarly, the vertical flange assembly for bracket 488 is shown at 520*b* and the corresponding vertical flange assembly for bracket 496 is shown at 520*c*. The horizontal lower intermediate flange assembly for bracket 480 is represented at 521*a*. That assembly, as well as assemblies 521*b* and 521*c* are structured essentially identically as respective assemblies 515*a*, 515*b* and 515*c*.

Following the mounting of the sequences of vertically aligned attachment brackets as represented generally at 470–472, channel-form panel support components are mounted upon the brackets and, following their proper alignment, will present magnetically responsive panel connector surfaces in what appears as a rectangular lattice. Formed with the bottom horizontal panel support component will be an upwardly opening panel receiving and supporting platform which, as before, receives the bottom edge of each main panel to retain it in compressive support as the panel is held to verticality by the magnetic attachment provided by rearward surface mounted magnet strips. A portion of this lattice assembly is revealed at wall segment 530 which extends between the outside corner 464 and inside corner 466. In this regard, portions of a sequence of vertically aligned attachment brackets are shown generally at 532. In this regard, a vertical top flange assembly 534 forming the vertical component of an L-shaped bracket similar to that shown at 508*c* is shown. At the bottom of the sequence 532 a vertical bottom flange assembly is shown at 536 representing one component of a bracket identical to that shown at 490. Below and aligned with vertical top flange assembly 534 is a vertical upper intermediate flange assembly 538. Assembly 538 is a component of a T-shaped bracket identical to that shown at 494. Beneath assembly 538 is a vertical lower intermediate flange assembly 540. Assembly 540 is one component of a T-shaped bracket which is identical to bracket 496. The horizontal bottom flange assembly associated with vertical flange assembly 536 is shown having been covered or combined with a bottom horizontal panel support component or base snap molding 542. Panel support component 542 is configured having an outwardly extending, upwardly opening panel receiving and supporting platform 544 which is configured to receive the bottom edge of the panel. The outwardly facing flat surface of the panel support component 542 provides a magnetically responsive bottom panel connector surface 546. In general, the panel support component 542 is formed of a ferrous metal and thus the surface 546 is suited for magnetic engagement with a strip magnet adhesively affixed in adjacency with the bottom edge of the panel. A top horizontal panel support component or top snap molding is shown at 548. Similarly, an upper intermediate horizontal panel support component and a lower intermediate panel support component are shown respectively at 550 and 552.

An elongate vertical panel support component or vertical snap molding will be positioned over and fastened to the vertical flange assemblies 534, 538, 540 and 536. A corresponding vertical panel support component particularly suited for an outside corner mounting is represented generally at 554. Component 554 presents a flat, magnetically responsive connector surface 556. A similar surface is shown at 558 which extends within wall segment 560. Surfaces 556 and 558 are configured to provide a point defining panel edge receiving structure 562. Wall segment 560 is illustrated showing a lattice-like structure of the panel support components, certain of which are seen at 564–567. A panel receiving and supporting platform extends horizontally at 570 and is represented providing abutting compressive support to the vertically oriented panel 572. A top, L-shaped cover or top L-clip 574 is shown extending above the lattice arrangement of support components.

Figure 13:
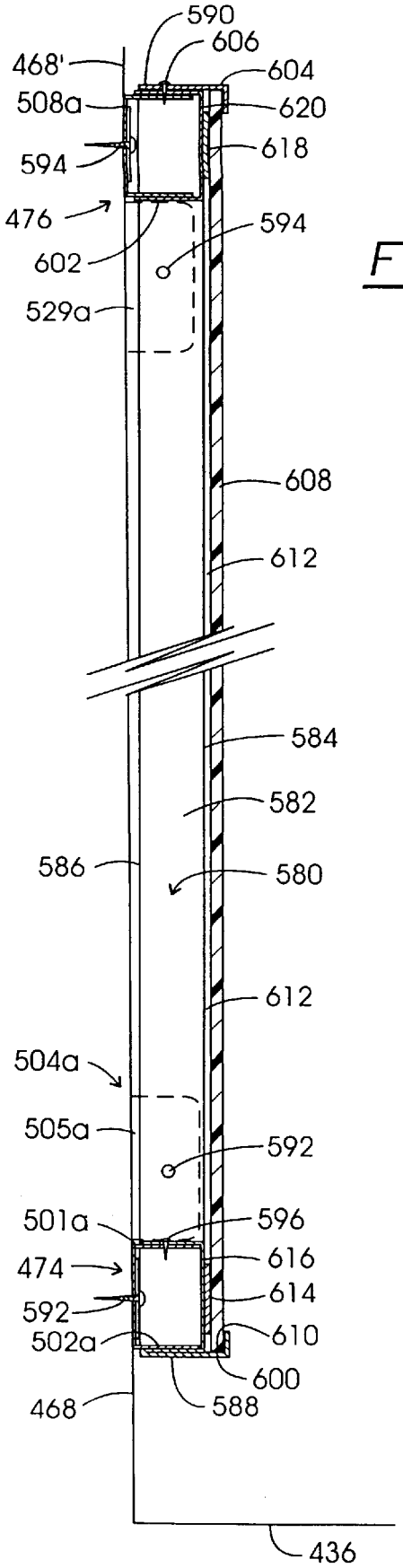
FIG. 13 is a broken away sectional view showing the mounting of a vertical panel support component in accordance with the invention.

Referring to FIG. 13, the installation of a vertical panel support component and an associated panel is shown in sectional detail and in broken away fashion at 580. For convenience, the support component 580 is illustrated in connection with its mounting to earlier described brackets 474 and 476 in conjunction with wall 468 and floor 436. For the instant demonstration, wall 468 is seen to be out of verticality or out of plumb, this condition being particularly evidenced at the wall region 468'. Vertical panel support component 580 has a channel-form cross section with two inwardly depending flanges extending from a web or base which functions as a noted panel connector surface. One such flange is shown at 582 and the base or connector surface is shown at 584. Note that the edge 586 of the flange 582 extends gradually outwardly from its bottom end 588 to its top end 590. With such an arrangement, the connector surface 584 may be made to be vertical or plumb. The support component 580 is attached through its flanges to the vertical bottom flange assembly 504*a* utilizing self-tapping sheet metal screws or the like, one of which is represented at 592. A similar connection is made with vertical top flange assembly 509*a* as represented by the self-tapping sheet metal screw 594. The figure shows that the attachment brackets 474 and 476 are attached to the wall 468 through holes formed within the web or base portions of the flange assemblies. The size of anchor employed will depend upon the type of wall and condition thereof. For simplicity, common screws in combination with fender washers are illustrated at 592 in connection with bracket 474 and at 594 in connection with bracket 476. Note that a bottom horizontal support component having a channel-form cross sectional configuration at 596 slides over or surmounts the horizontal bottom flange assembly 500*a*, and in particular over the flange components 501*a* and 502*a*. This support component 596 is retained in position by self-tapping metal sheet screws one of which is shown at 598. Note additionally that the support component 596 incorporates an integrally formed, upwardly opening panel receiving and supporting platform 600.

A top horizontal panel support component 602 having a channel-form cross sectional configuration similarly is slidably nestably positioned over horizontal top flange assembly 508*a*. Additionally placed over the upper flange of assembly 508*a* is an L-shaped top L-clip or cap 604. Support component 602 and cap 604 are retained in position by self-tapping sheet metal screws, one of which is revealed at 606. With the arrangement shown, a panel 608 is positioned such that its bottom edge 610 is abuttably positioned upon platform 600 and its magnet strips are located for magnetic engagement with the panel support surfaces. In the figure, vertical magnet strip 612, which is adhesively secured to the rear surface of panel 608, is seen to be in magnetically attractive contact with connector surface 584. A horizontally disposed magnet strip 614, which is adhesively attached to the rearward surface of panel 608, is seen to be in magnetic attachment with the magnetically responsive connector surface 616 of bottom horizontal support component 596. Correspondingly, an upper horizontally disposed magnet strip 618 is seen to be in magnetic contact with the magnetically responsive connector surface 620 of top horizontal panel support component 602. Similar connections are provided, for example, with respect to intermediate brackets 478 and 480 but which are not shown in the instant figure in the interest of clarity.

Figure 14:
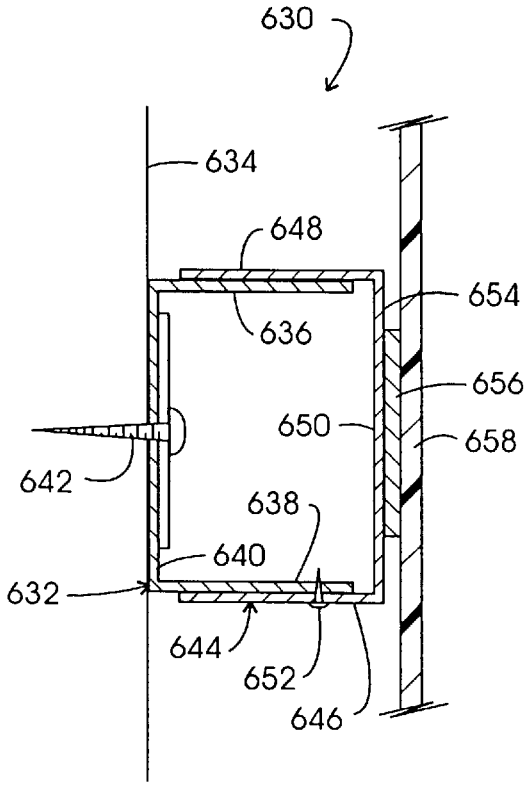
FIG. 14 is a sectional view showing the mounting of a horizontal panel support component according to the invention.

Referring to FIG. 14, a typical mounting of a horizontal flange assembly, horizontal panel support component and wall panel is represented generally at 630. In the figure, a horizontal flange assembly, represented generally at 632, is seen to be mounted upon a wall 634. Assembly 632 includes two, spaced apart, parallel flanges 636 and 638 integrally formed and extending from a web or base 640. That base 640 is seen to be attached to the wall 634 using an anchor arrangement herein represented as a screw and fender washer assembly 642. Nestably, slidably positioned over the horizontal flange assembly 632 is a horizontal panel support component 644 formed of magnetically responsive material and having spaced apart parallel flanges 646 and 648 integrally formed with and extending inwardly from base or web 650. Connection between the support component 644 and the flange assembly 632 is by self-tapping sheet metal screws, one of which is represented at 652. With this arrangement, the base 650 provides a panel connector surface which becomes magnetically attached to a strip magnet 656 adhesively attached, in turn to the rearward surface of a wall panel 658.

Figure 15:
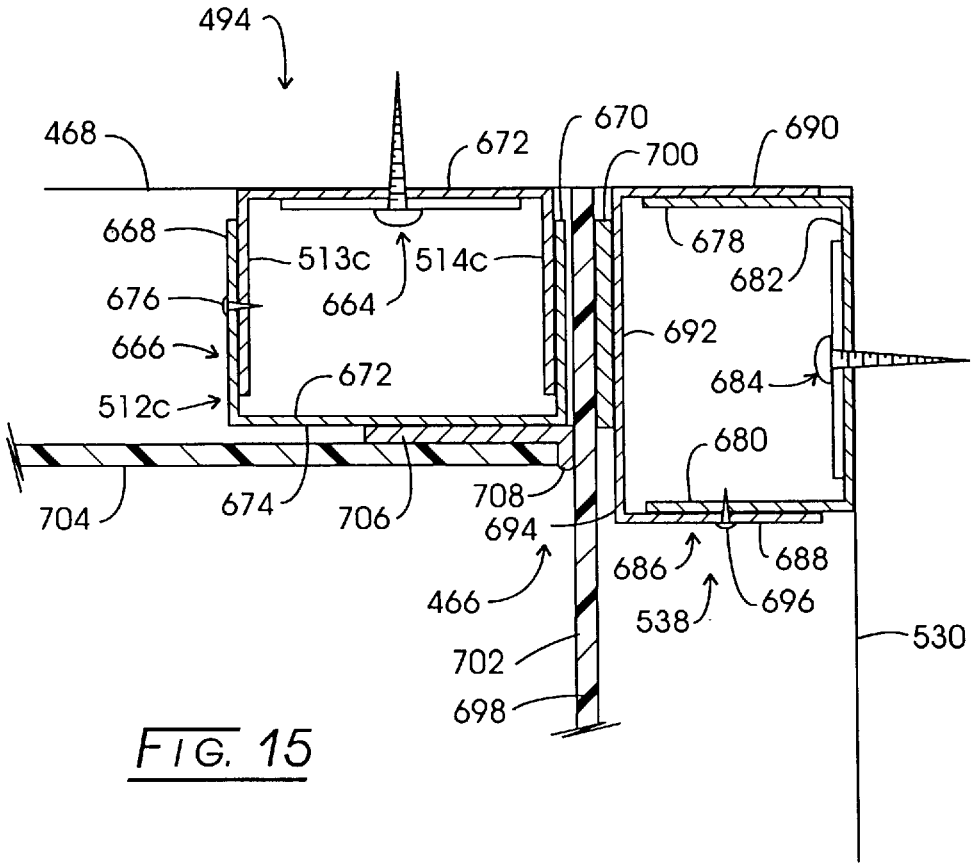
FIG. 15 is a partial sectional view showing a structure for mounting wall panels according to the invention at an inside comer.

Referring to FIG. 15, a sectional view of the mounting of the wall panel system at an inside corner is provided. For clarity, the identifying numeration associated with the upper intermediate bracket 494 and vertical flange assembly 558 described in FIG. 12 is utilized. Wall segments 468 and 530 again are identified in the figure along with an identification of the inside corner line 466. Vertical flange assembly 512*c* again is shown to be formed of outwardly extending flanges 513*c* and 514*c*. These flanges are integrally formed with an assembly base or web 662. The flange assembly 512*c* is seen to be connected with the wall segment 468 by an anchor arrangement here shown as a screw and fender washer assembly 664. Nestably positioned over the vertical flange assembly 512*c* is a vertical panel support shown generally at 666 and comprised of two, parallel, spaced apart flanges 668 and 670 which are integrally formed with and extend inwardly from a base or web 672, the outwardly disposed surface 674 thereof thus forming a panel connector surface. Vertical panel support 666 is fixed to the flange assembly 512*c* by self-tapping sheet metal screws one of which is represented at 676.

Vertical upper intermediate flange assembly 538 is seen to include vertical, spaced apart parallel flanges 678 and 680 which are integrally formed with and extend outwardly from a base or web 682. Base 682 is coupled to the wall 530 by a user selected anchor assembly, here shown as a fender washer and screw assembly 684. Nestably positioned over the flange assembly 538 is a vertical support component 686 having spaced apart parallel flanges 688 and 690 which are integrally formed with and extend from a magnetically responsive base or web 692 which serves to define a panel connector surface 694. Support component 686 is connected to flange assembly 538 by self-tapping sheet metal screws one of which is shown at 696.

A wall panel 698 to which a vertically disposed strip magnet 700 is adhesively attached is seen to be magnetically coupled to the connector surface 694. The forward surface 702 of panel 698 is seen to be thus located in relatively close adjacency with flange 670 of panel support 666. A transversely disposed wall panel 704 to which an earlier-described L-shaped magnet strip 706 is adhesively attached is seen to magnetically supported at connector surface 674. Note that the bead portion 708 of the magnet strip 706 extends between the side edge of panel 704 and forward surface 702 of panel 698. Such an arrangement achieves an artistically desirable interceptive union between panels 698 and 704.

Figure 16:
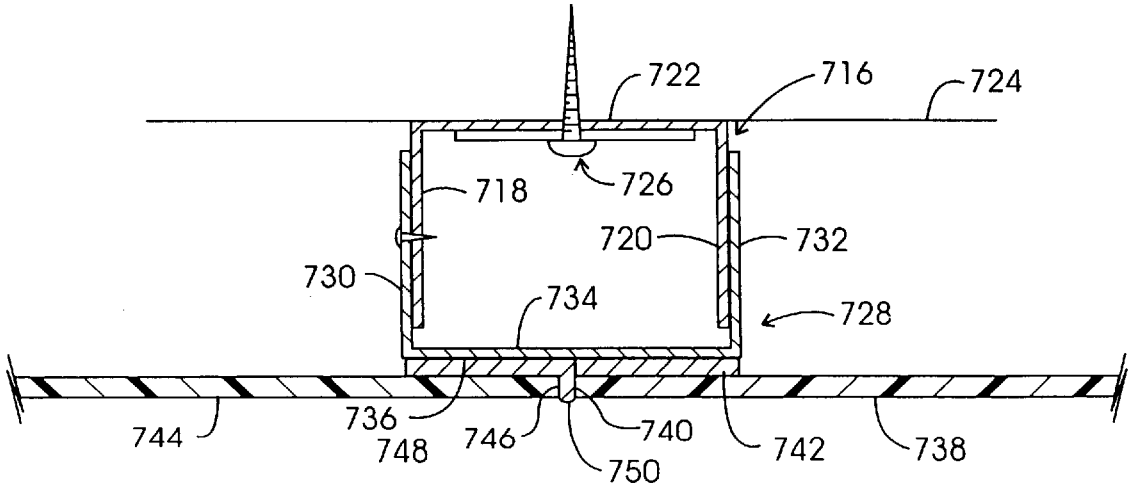
FIG. 16 is a partial sectional view showing the mounting of adjacently disposed panels at a vertical panel support component assemblage and bracket assemblage.

Referring to FIG. 16, a vertical magnetic support of adjacent wall panels is illustrated in sectional fashion. In the figure, a vertical flange assembly represented generally at 716 is shown to comprise paired, vertical, spaced apart, parallel flanges 718 and 720 which are integrally formed with and extend outwardly from a base or web 722. Base 722, in turn, is coupled to a wall 724 by a screw and fender washer assembly 726. Nestably positioned over the vertical flange assembly 716 is a vertical panel support component 728. Panel 728 is formed having two, spaced apart, parallel flanges 730 and 732 which extend inwardly from and are formed integrally with a magnetically responsive base or web 734. The outwardly disposed face of the base 734 forms a magnetically responsive connector surface 736. Surface 736 magnetically supports a wall panel 738 which extends to a panel edge 740. A vertical strip magnet 742 is adhesively attached to the rearward surface of panel 738 adjacent the edge 740 and is in magnetic attachment with the connector surface 736. Adjacent the panel 738 is another wall panel 744 which extends to a vertically disposed panel edge 746. A strip magnet 748 of the above-noted L-shape variety is adhesively attached to the rearward face of panel 744 adjacent edge 746. Magnet 748 has an integrally formed bead structure 750 which is seen to establish the vertical union between panel edges 740 and 746 to provide an aesthetically pleasing appearance for the wall panel system.

Figure 17:
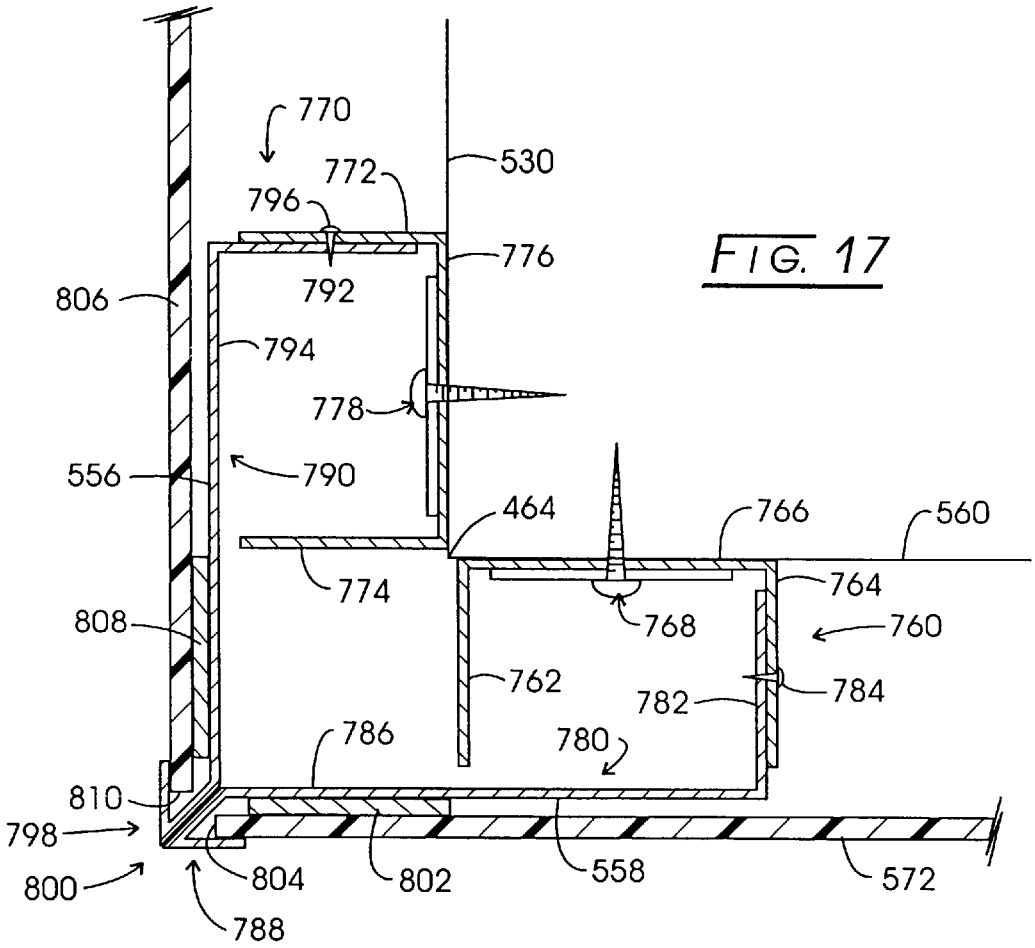
FIG. 17 is a partial sectional view showing the mounting structure for positioning wall module panels according to the invention at an outside comer.

Referring to FIG. 17 an outside corner mounting implementation of the system is portrayed in sectional fashion. For clarity, components representing the outside corner 464 described in conjunction with FIG. 12 are identified with the same numeration. In this regard it may be observed that wall segment 560 is shown to intersect wall segment 530 to define the comer 464. Mounted upon wall 560 adjacent the corner 464 is the vertical flange assembly 760 of a bracket. Flange assembly 760 includes two parallel, spaced apart vertical flanges 762 and 764 which extend outwardly from a base or web 766. Bracket connection is provided, inter alia, by a suitable anchor, here represented as a screw and fender washer assembly 768.

In similar fashion, the vertical flange assembly of another bracket is shown to provide paired, outwardly extending, parallel flanges 772 and 774 which are integrally formed with a web or base 776. The bracket associated with assembly 770 is attached to the wall 530 by suitable anchors. In the instant figure, a screw and fender washer assembly 778 is seen to be extending into wall 530.

The vertical panel support components are modified for this outside corner installation. In this regard, one such panel support component is shown at 780. Component 780 incorporates a singular flange 782 which is attached by self-tapping sheet metal screws, one of which is shown at 784, to the inside surface of flange 764. Extending normally from the flange 782 is a base 786, the outward surface of which forms the panel connector surface 558. Base 786 continues to form an angular panel receiving slot assembly 788. In similar fashion, a modified vertical support component 790 is shown to be formed with a singular flange 792 extending normally from a base 794, the outwardly disposed face 556 of which forms a panel connector surface. Flange 792 is attached to the interior surface of flange 772 by self-tapping sheet metal screws, one of which is shown at 796. Base 556 is seen to extend to a panel receiving slot assembly 798 which cooperates in adjacency with assembly 788 to define an outside wall corner 800.

Panel 572 is seen connected with a vertically oriented strip magnet 802 which is adhesively attached in adjacency with panel edge 804. In turn, the edge 804 is seen to be inserted within the panel receiving slot assembly 788. In similar fashion, a panel 806 supports an adhesively attached strip magnet 808 which is positioned adjacent the panel edge 810 and is magnetically attached to the connector surface 556. Note, as before that the edge 810 of panel 806 extends within the panel receiving slot assembly 798.

Figure 18:
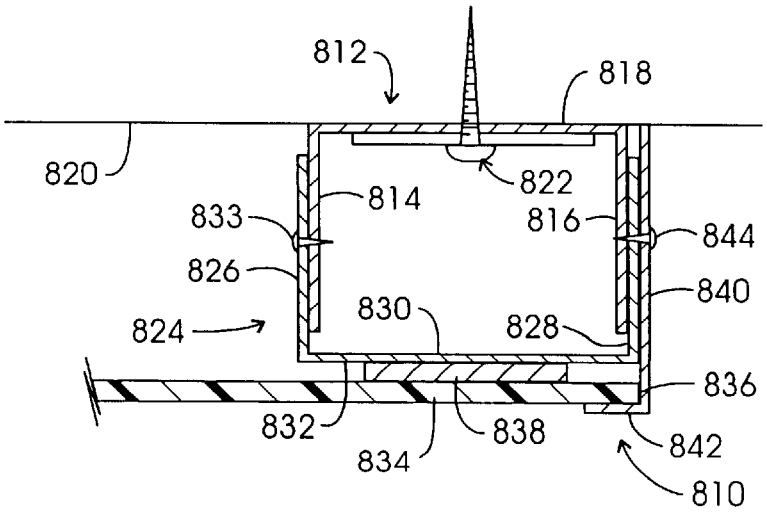
FIG. 18 is a partial sectional view showing a vertical component assemblage and wall panel at a vertical termination of the wall panel system.

Referring to FIG. 18, an assemblage for terminating or ending a wall panel system according to the invention is revealed generally at 810. In the figure, a vertical flange assembly of a bracket is shown generally at 812 to incorporate paired, parallel, spaced apart flanges 814 and 816 which are integrally formed with and extend from a base or web 818. Base 818 and its associated bracket is attached to a wall 820 by an assemblage of anchors one of which is represented herein as a screw and fender washer assembly 822. Nestably positioned over the vertical flange assembly 812 is a vertical panel support component 824. Component 824 is formed having paired, parallel, spaced apart vertically oriented flanges 826 and 828 which are integrally formed with and extend inwardly from a web or base 830, the outwardly disposed face of which forms a panel connector surface 832. Support component 824 is attached to the vertical flange assemble 812 by self-tapping sheet metal screws one of which is shown at 833. A wall panel 834 is seen extending to a panel edge 836 and a vertically disposed strip magnet is adhesively attached to its rearward face at a location for magnetic attachment to the connector surface 832. Additionally attached to the flanges 816 and 828 is a vertically oriented, L-shaped end cap 840 having a forwardly positioned flange 842. End cap 840 is attached to the flanges 816 and 828 by self-tapping sheet metal screws one of which is shown at 844. In positioning the panel 834, the edge thereof 836 is seen to be located so as to be covered by the flange 842. Since certain changes may be made in the above-described apparatus and system without departing from the scope of the invention herein, it is intended that all matter contained in the description thereof or shown in the accompanying drawings shall be interpreted as illustrative and not in a limiting sense

What is claimed is:

1. A system for providing a paneled surface upon an interior wall extending from the floor of a facility, comprising:

a first sequence of vertically aligned attachment brackets fixed to said wall including:

(a) a first bottom bracket having an outwardly extending first horizontal bottom flange assembly located a predetermined height above said floor, and an outwardly extending first vertical bottom flange assembly located above said first horizontal flange assembly, (b) a first top packet having an outwardly extending first horizontal top flange assembly located a height corresponding with a panel height above said first horizontal bottom flange, and an outwardly extending first vertical top flange assembly located below said first horizontal top flange assembly;

a second sequence of vertically aligned attachment brackets fixed to said wall and spaced horizontally from said first sequence of vertically aligned attachment brackets, including:

(a) a second bottom bracket having an outwardly extending second horizontal bottom flange assembly located in horizontal alignment with said first horizontal bottom flange assembly and an outwardly extending second vertical bottom flange assembly located above said second horizontal flange assembly and spaced from said first vertical bottom flange assembly a distance corresponding with a panel width;

(b) a second top bracket having an outwardly extending second horizontal top flange assembly horizontally aligned with said horizontal top flange assembly, and an outwardly extending second vertical top flange assembly located below said second horizontal top flange assembly;

a first vertical panel support component connected with said first vertical bottom flange assembly and said first vertical top flange assembly and having an outwardly disposed, magnetically responsive first vertical panel connector surface;

a second vertical panel support component conencted with said second vertical bottom flange assembly and said second vertical top flange assembly and having an outwardly disposed, magnetically responsive second vertical panel connector surface;

a first bottom horizontal panel support component connected with said first horizontal bottom flange assembly and said second horizontal bottom flange assembly and having an outwardly disposed, magnetically responsive bottom panel connector surface;

a first top horizontal panel support component connected with said first horizontal top flange assembly and said second horizontal top flange assembly and having an outwardly disposed magnetically responsive top panel connector surface;

an upwardly opening panel receiving and supporting platform fixed to said first bottom bracket and said second bottom bracket and extending outwardly from said bottom panel connector surface; and a first thin wall panel having panel forward and rearward surfaces with generally rectangle defining bottom, top and first and second panel edges, and having magnetically responsive panel connector components located at said rearward surface adjacent said first and second panel edges, a said connector component adjacent said first panel first panel edge being in removable magnetic connection with said first vertical panel connector surface, a said connector component adjacent said first panel second panel edge being in removable magnetic connection with said second vertical panel connector surface, and said first panel bottom edge being in compression deriving abutting supporting engagement with said panel receiving and supporting platform.

2. The system of claim 1 in which:

a said magnetically responsive connector component is located adjacent said first panel top panel edge; and said connector component adjacent said first panel top panel edge being in removable magnetic connection with said top panel connector surface.

3. The system of claim 2 in which:

a said magnetically responsive connector component is located adjacent said first panel bottom panel edge; and said connector component adjacent said first panel bottom panel edge being in removable magnetic connection with said bottom panel connector surface.

4. The system of claim 1 in which said first sequence of verically aligned attachment brackets include:

(c) A first upper intermediate bracket having an outwardly extending first horizontal upper intermediate flange assembly located at an elevation above said floor selected to structurally support said first thin wall panel against inwardly directed force asserted upon said first thin wall panel forward surface adjacent thereto by the shoulder of a leaning, standing adult human, and an outwardly extending first vertical upper intermediate flange assembly located in adjacency with said first horizontal upper intermediate flange assembly;

said second sequence of vertically aligned attachment brackets includes:

(c) a second upper intermediate bracket having an outwardly extending second horizontal upper intermediate flange assembly horizontally aligned with said first horizontal upper intermediate flange assembly, and an outwardly extending second vertical upper intermediate flange assembly located in adjacency with said second horizontal upper intermediate flange assembly;

said first vertical panel support component is connected with said first vertical upper intermediate flange assembly;

said second vertical panel support component is connected with said second vertical upper intermediate flange assembly;

including a first upper intermediate horizontal panel support component connected with said first horizontal upper intermediate flange assembly and said second horizontal upper intermediate flange assembly and having an outwardly disposed, magnetically responsive upper intermediate horizontal panel connector surface; and said first wall panel includes a magnetically responsive horizontally disposed connector component located at said rearward surface at a location for effecting removable magnetic engagement with said upper intermediate horizontal panel connector surface.

5. The system of claim 1 in which:

said first sequence of vertically aligned attachment brackets include:

(d) a first lower intermediate bracket having an outwardly extending first horizontal lower intermediate flange assembly located at an elevation above said floor corresponding with a wainscot height selected to provide structural support of said first thin wall panel adjacent thereto against inwardly directed force asserted upon said first thin wall panel forward surface and an outwardly extending first vertical lower intermediate flange assembly located in adjacency with said first horizontal lower intermediate flange assembly;

said second sequence of vertically aligned attachment brackets includes:

(d) a second lower intermediate bracket having an outwardly extending second horizontal lower intermediate flange assembly horizontally aligned with said first horizontal lower intermediate flange assembly, and an outwardly extending second vertical lower intermediate flange assembly located in adjacency with said second horizontal lower intermediate flange assembly;

said first vertical panel support component is connected with said first vertical lower intermediate flange assembly;

said second vertical panel support component is connected with said second vertical lower intermediate flange assembly;

including a first lower intermediate horizontal panel support component connected with said first horizontal lower intermediate flange assembly and said second horizontal lower intermediate flange assembly and having an outwardly disposed, magnetically responsive lower intermediate horizontal panel connector surface; and said first wall panel includes a magnetically responsive horizontally disposed connector component located at said rearward surface at a location for effecting removable magnetic engagement with said lower intermediate horizontal panel connector surface.

6. The system of claim 1 in which:

said magnetically responsive first and second vertical panel connector surfaces are substantially flat and formed with ferrous metal; and said magnetically responsive panel connector components are flat magnet strips of predetermined widthwise dimension fixed to said first panel rearward surface.

7. The system of claim 1 in which:

said first horizontal bottom flange assembly, said first horizontal top flange assembly, said second horizontal bottom flange assembly and said second horizontal top flange assembly are each formed of paired, parallel spaced apart bracket flanges extending outwardly from said wall; and said first bottom horizontal panel support component and said first top horizontal panel support component are each formed as a channel having inwardly extending paired parallel channel flanges mutually spaced apart a distance effective to engage said paired bracket flanges and a flat outwardly disposed web, the outwardly disposed surface of which is a respective said magnetically responsive bottom panel connector surface and said magnetically responsive top panel connector surface.

8. The system of claim 1 in which:

said first vertical bottom flange assembly, said first vertical top flange assembly, said second vertical bottom flange assembly and said second vertical top flange assembly are each formed of paired, parallel spaced apart bracket flanges extending outwardly from said wall; and said first vertical panel support component and said second vertical panel support component are each formed as a channel having inwardly extending, paired parallel channel flanges mutually spaced apart a distance effective to engage said paired bracket flanges and a flat outwardly disposed web, the outwardly disposed surface of which is a respective said magnetically responsive first vertical panel connector surface and said magnetically responsive second vertical panel connector surface.

9. The system of claim 1 comprising:

a third sequence of vertically aligned attachment brackets fixed to said wall and spaced horizontally from said second sequence of vertically aligned attachment brackets, including:

(a) a third bottom bracket having an outwardly extending third horizontal bottom flange assembly located in horizontal alignment with said second horizontal bottom flange assembly and an outwardly extending third vertical bottom flange assembly located above said third horizontal bottom flange assembly and spaced from said second vertical bottom flange assembly a distance corresponding with a panel width, (b) a third top bracket having an outwardly extending third horizontal top flange assembly horizontally aligned with said second horizontal top flange assembly, and an outwardly extending third vertical top flange assembly located below said third horizontal top flange assembly;

a third vertical panel support component connected with said third vertical bottom flange assembly and said third vertical top flange assembly and having an outwardly disposed, magnetically responsive third vertical connector surface;

said first bottom horizontal panel support component being connected with said third horizontal bottom flange assembly;

said first top horizontal panel support component being connected with said third horizontal top flange assembly;

said upwardly opening panel receiving and supporting platform is connected to said third bottom bracket; and a second thin wall panel having panel forward and rearward surfaces with generally rectangle defining bottom, top and first and second panel edges, and having magnetically responsive panel connector components located at said rearward surface adjacent said first and second panel edges, a said connector component adjacent to said second panel first panel edge being in removable magnetic connection with said second vertical panel connector surface, a said connector component adjacent said second panel second panel edge being in removable magnetic connection with said third vertical panel connector surface, and said second panel bottom edge being in compression-deriving abutting supporting engagement with said panel receiving and supporting platform.

10. The system of claim 9 in which:

said magnetically responsive first, second and third vertical panel connector surfaces are substantially flat and formed with ferrous metal; and said magnetically responsive panel connector components are flat magnet strips of predetermined widthwise dimension fixed to said first panel rearward surface and said second panel rearward surface.

11. The system of claim 9 in which:

said magnetically responsive first, second and third vertical panel connector surfaces are substantially flat and formed with ferrous metal; and said magnetically responsive connector component located adjacent said second wall panel first panel edge is configured in generally L-shaped, having a forwardly extending bead-defining spacer portion extending adjacent said second wall panel first panel edge and outwardly from said second panel forward surface.

* * * * *